US005105590A

United States Patent [19]

Dykmans

[11] Patent Number: 5,105,590

[45] Date of Patent: Apr. 21, 1992

[54] APPARATUS FOR CONSTRUCTING CIRCUMFERENTIALLY WRAPPED PRESTRESSED STRUCTURES UTILIZING A MEMBRANE INCLUDING SEISMIC COUPLING

[76] Inventor: Max J. Dykmans, 1214 Pioneer Way, El Cajon, Calif. 92022-0696

[21] Appl. No.: 436,479

[22] Filed: Nov. 14, 1989

Related U.S. Application Data

[60] Division of Ser. No. 915,269, Oct. 3, 1986, Pat. No. 4,879,859, which is a continuation-in-part of Ser. No. 559,911, Dec. 9, 1983, Pat. No. 4,776,145.

[51] Int. Cl.[5] ..... E04H 7/00

[52] U.S. Cl. ..... 52/741; 52/224; 52/573; 52/247

[58] Field of Search ..... 52/167 R, 167 CB, 167 DF, 52/393, 573, 704, 707-711, 223 R, 223 L, 224, 169.6, 169.7, 245, 247, 248-249, 309.1, 309.12, 309.16, 309.17, 2 E; 248/636, 638; 264/33

[56] References Cited

U.S. PATENT DOCUMENTS

| | | | |
|---|---|---|---|
| 2,250,175 | 7/1941 | Blaski | 52/293 |
| 2,952,947 | 9/1960 | White | 52/711 X |
| 3,233,376 | 2/1966 | Naillon et al. . | |
| 3,619,431 | 11/1971 | Weaver et al. | 264/33 |
| 3,872,634 | 3/1975 | Seaman | 52/80 X |
| 3,927,497 | 12/1975 | Yoshinaga et al. | 52/247 |
| 4,068,777 | 1/1978 | Humphrey et al. | 52/224 X |
| 4,069,642 | 1/1978 | Hendriks | 52/224 |
| 4,094,110 | 6/1978 | Dickens et al. | 52/80 |
| 4,170,093 | 10/1979 | Cappellini et al. | 52/2 E |
| 4,269,011 | 5/1981 | Ikonomou | 52/167 R |
| 4,317,317 | 3/1982 | Kilts et al. | 52/224 |

FOREIGN PATENT DOCUMENTS

| | | | |
|---|---|---|---|
| 788927 | 6/1928 | Australia | 52/245 |
| 549619 | of 0000 | France . | |
| 1383795 | 11/1964 | France | 52/249 |

*Primary Examiner*—David A. Scherbel
*Assistant Examiner*—Wynn Wood
*Attorney, Agent, or Firm*—Lyon & Lyon

[57] ABSTRACT

The present invention is directed to improved tank structures and apparatus for their construction. The walls of the prestressed tank are formed by inflating a membrane, applying one or more layers of rigidifying material outwardly of said membrane and then prestressing the walls by circumferentially wrapping prestressing material to minimize the tension in the rigidifying material when subject to loading. In another embodiment, wall forms are placed inwardly of said membrane to aid in the forming of the walls and circumferential prestressing. In the best mode of the invention, the walls are of reinforced plastic, fiber-reinforced plastic, or resin sandwich composite construction. This application focuses on seismic countermeasures which may also be used to protect the structure against earthquakes and other tremors, by the anchoring of the tank walls to the base and permitting the seismic forces to be shared by the seismic anchors. When a seismic disturbance occurs, the force acting on the structure can be transmitted and distributed to the footing and around the circumference of the tank.

6 Claims, 12 Drawing Sheets

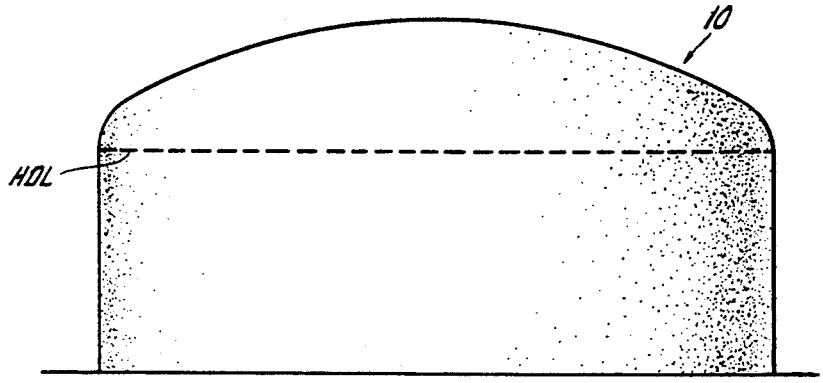
FIG. 1.
FIG. 4.
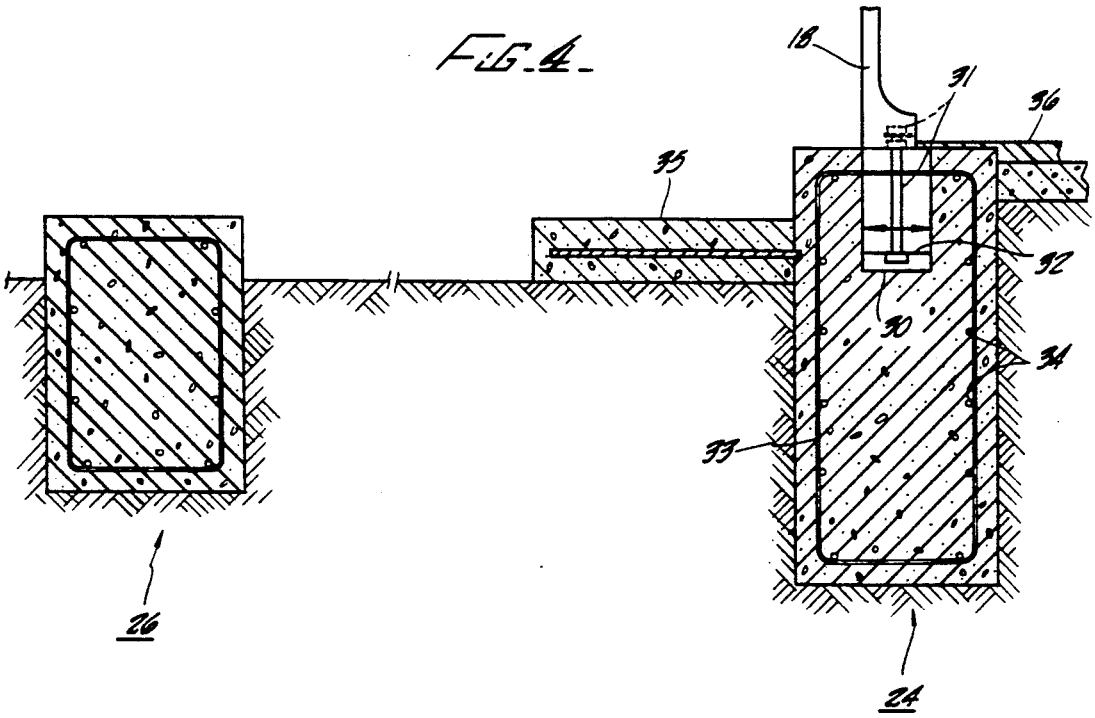

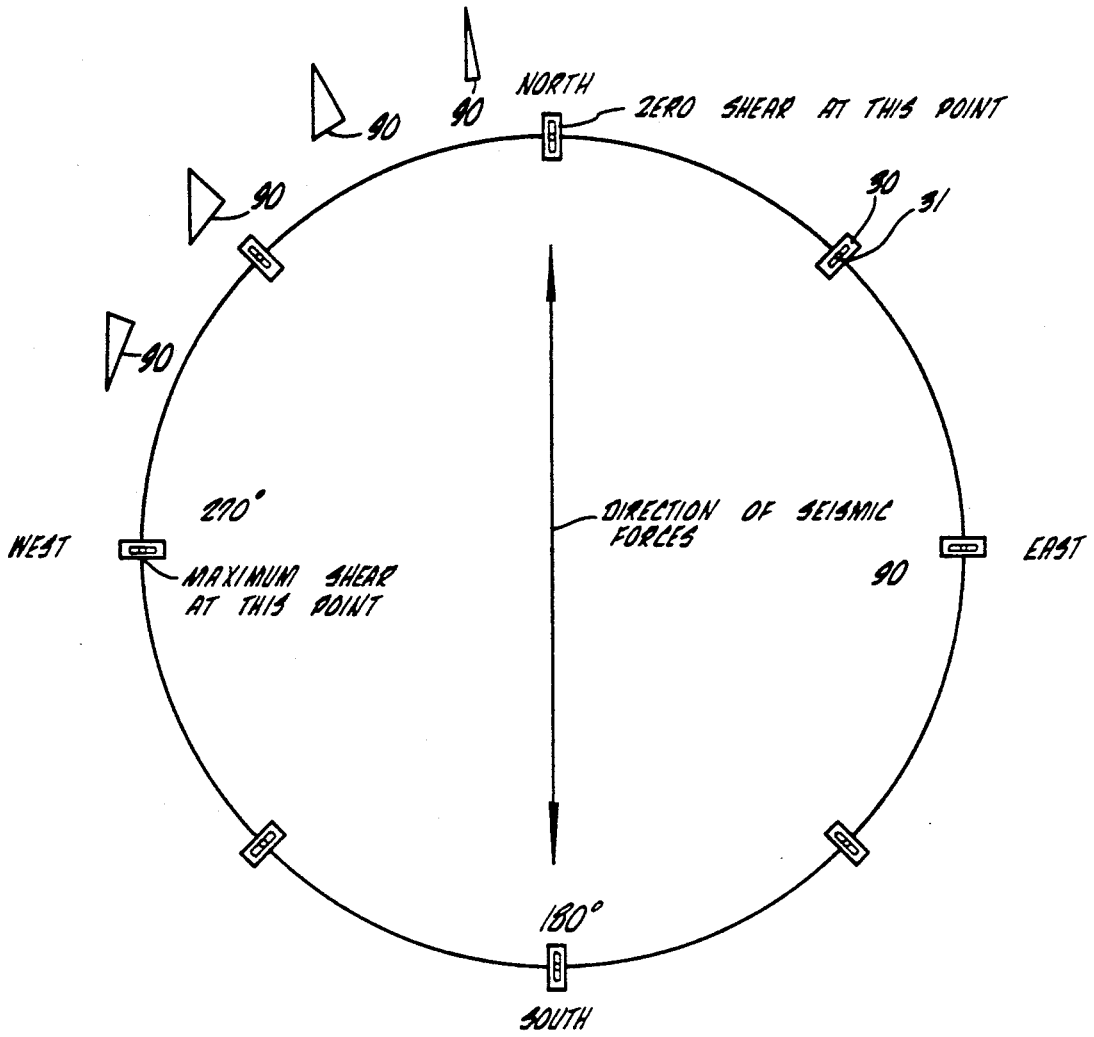
FIG. 7
FIG. 6
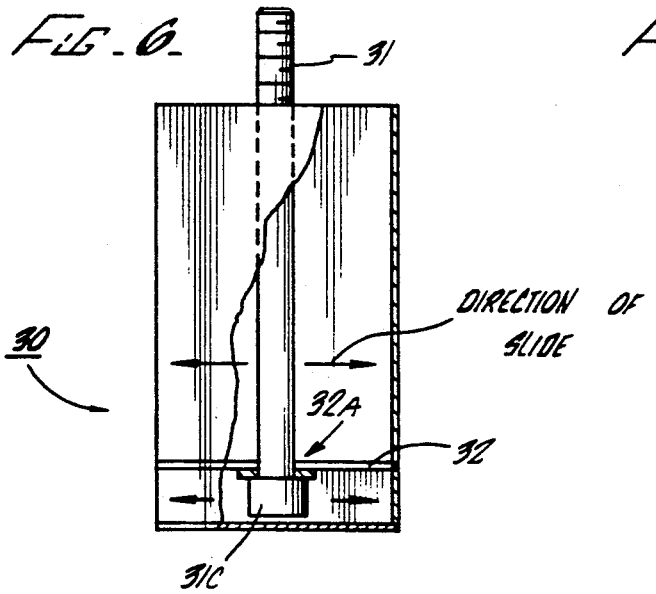
FIG. 5
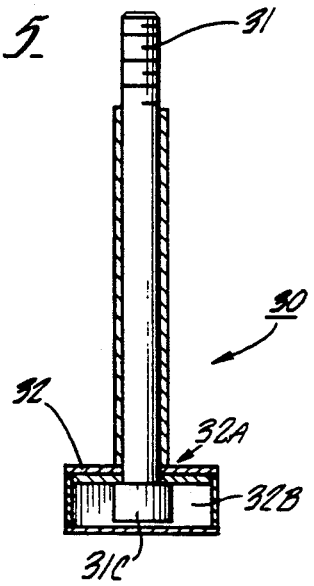

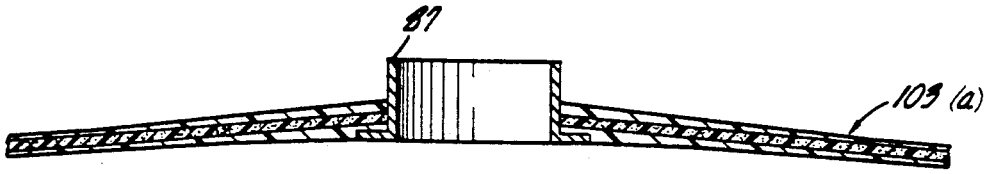
FIG. 22.
FIG. 24.
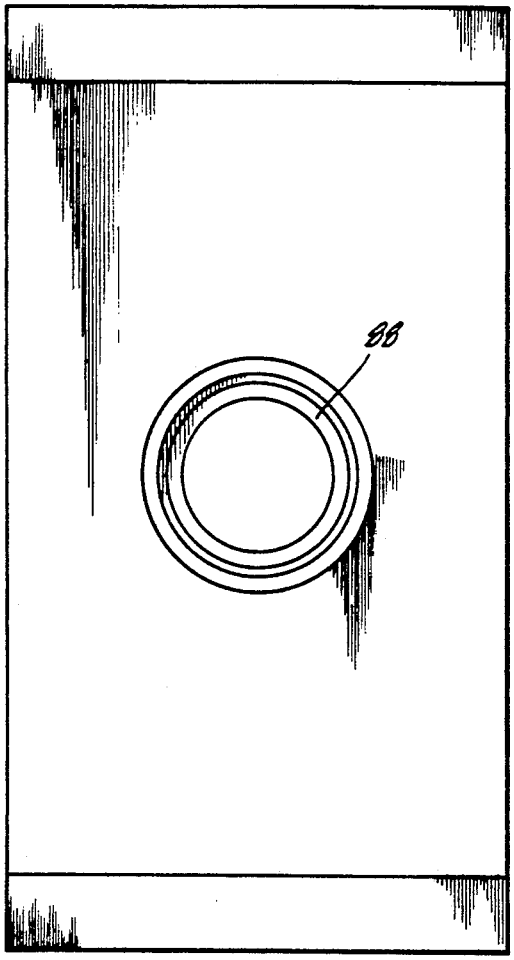
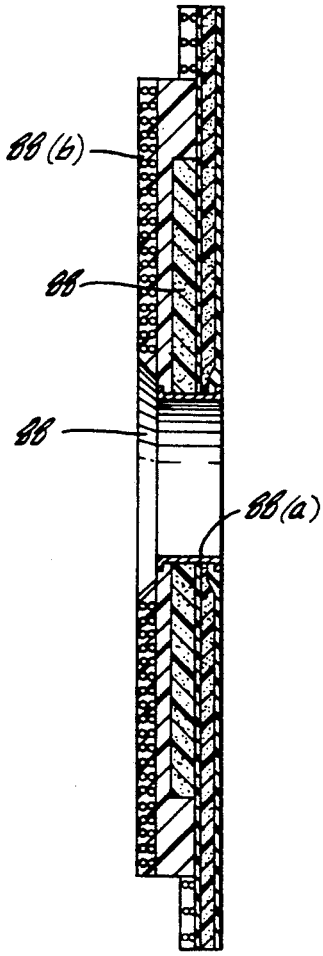
FIG. 23.

APPARATUS FOR CONSTRUCTING CIRCUMFERENTIALLY WRAPPED PRESTRESSED STRUCTURES UTILIZING A MEMBRANE INCLUDING SEISMIC COUPLING

This is a divisional of application Ser. No. 915,269 filed on Oct. 3, 1986 (by the same inventor Max J. Dykmans and entitled "Method and Apparatus for Constructing Circumferentially Wrapped Prestressed Structures Utilizing a Membrane" which issued as U.S. Pat. No. 4,879,859 on Nov. 4, 1989) which in turn is a continuation-in-part of application Ser. No. 559,911 filed Dec. 9, 1983 (by the same inventor Max J. Dykmans and entitled "Multi-Purpose Dome Structure and Construction Thereof" which issued on Oct. 11, 1988 as U.S. Pat. No. 4,776,145).

BACKGROUND OF THE INVENTION

The field of the invention is of circumferentially wrapped prestressed structures, and their construction, which structures can be used to contain liquids, solids or gases. The invention is particularly useful in the construction of domed prestressed structures.

There has been a need for the improved construction of these types of structures, as conventional construction has proven difficult and costly. Many of these structures have had problems with stability and leakage, in part, due to the high pressures exerted by certain of the stored fluids and cracking due to differential dryness and temperature. Because of these deficiencies, many have required substantial wall thickness or other measures to contain the fluids, requiring inordinately high-costs for their construction. Furthermore, these structures generally do not lend themselves to automation.

Certain of these conventional structures have utilized inflated membranes. Indeed, inflated membranes have been used for airport structures where the structure consists of the membrane itself. Inflated membranes have also bee used to form concrete shells wherein a membrane is inflated and used as a support form. Shocrete, with or without reinforcing, is sometimes placed over the membrane and the membrane is removed after the concrete is hardened.

Another form of construction is exemplified by conventional "Binishell" structures. These are constructed by placing metal springs and regular reinforcing bars over an uninflated lower membrane. Concrete is then placed over the membrane and an upper membrane is placed over the concrete to prevent it from sliding to the bottom as the inflation progresses. The inner membrane is then inflated while the concrete is still soft. After the concrete has hardened, the membranes are typically removed.

A major drawback of the afore-described conventional structures is the high cost connected with reinforcing and waterproofing them for liquid storage. Moreover, with regard to the "Binishell" structures, because of the almost unavoidable sliding of the concrete, it is difficult if not impossible to avoid honeycombing of the concrete and subsequent leaks. As a result, these structures have not been very well received in the marketplace and have thus far not displaced the more popular and commercially successful steel, reinforced concrete and prestressed concrete tanks and containment vessels, which we now discuss.

In the case of prestressed concrete tanks, prestressing and shotcreting are typically applied by methods set out in detail in my U.S. Pat. Nos. 3,572,596; 4,302,978; 3,869,088; 3,504,474; 3,666,189; 3,892,367 and 3,666,190 which are incorporated herein by reference. As set forth in these references, a floor, wall and roof structure is typically constructed out of concrete and conventional construction techniques. The wall is then prestressed circumferentially with wire or strand which is subsequently coated with shotcrete. The machinery used for this purpose is preferably automated, such as that set forth in the above patents. Shotcrete is applied to encase the prestressing and to prevent potential corrosion.

The primary purpose for prestressing is that concrete is not very good in tension but is excellent in compression. Accordingly, prestressing places a certain amount of compression on the concrete so that the tensile forces caused by the fluid inside the tank are countered not by the concrete, but by the compressive forces exerted by the prestressing materials. Thus, if design considerations are met, the concrete is not subjected to the substantial tension forces which can cause cracks and subsequent leakage.

Major drawbacks of the above prestressed concrete tank structure are the need for expensive forming of the wall and roof and for substantial wall thickness to support the circumferential prestressing force which places the wall in compression. Furthermore, cracking and imperfections in the concrete structure can cause leakage. Also, concrete tanks are generally not suitable for storage of certain corrosive liquids and petroleum products.

A second major category of tanks are those constructed out of concrete, and utilizing regular reinforcing in contrast to prestressing. These tanks are believed to be inferior to the tanks utilizing circumferential prestressing because, while regular reinforcing makes the concrete walls stronger, it does not prevent the concrete from going into tension, making cracking at even greater possibility. Typically, reinforcing does not come into play until a load is imposed on the concrete structure. It is intended to pick up the tension forces because, as previously explained, the concrete cannot withstand very much tension before cracking. Yet reinforcing does not perform this task very well because, unlike circumferential prestressing which preloads the concrete, there are not prestressing forces exerting on the concrete to compensate for the tension asserted by the loading. Moreover, as compared to prestressed concrete tanks, reinforced concrete tanks require even more costly forming of wall and roof, and even greater wall thicknesses to minimize tensile stresses in the concrete.

Another general category of existing tanks are those made of fiber-reinforced plastic. These fiberglass tanks have generally been small in diameter, for example, in contrast to the prestressed or steel tanks that can contain as many as 30 million gallons of fluid. The cylindrical walls are sometimes filament-wound with glass rovings. To avoid strain corrosion, (a not very well understood condition wherein the resins and/or laminates fracture, disintegrate or otherwise weaken) the tension in fiber reinforced plastic laminates is limited to 0.001 (or 0.1%) strain by applicable building codes or standards and by recommended prudent construction techniques. For example, the American Water Works Association (AWWA) Standard for Thermosetting Fiberglass, Reinforced Plastic Tanks, Section 3.2.1.2 requires that "the allowable hoop strain of the tank wall shall not exceed 0.0010 in/in." A copy of this standard is provided in the concurrently filed Disclosure Statement. Adhering to this standard means, for example, that if the modulus of elasticity of the laminate is 1,000,000 psi, then the maximum design stress in tension should not exceed 1,000 psi (0.001×1,000,000). Consequently, large diameter "fiber-reinforced plastic" tanks require substantially thicker walls than steel tanks. Considering that the cost of fiber-reinforced plastic tanks has been close to those of stainless steel, and considering the above strain limitation, there are believed to have been no large diameter fiber-reinforced plastic tanks built world-wide since fiberglass became available and entered the market some 35 years ago.

Another reason why large fiber-reinforced plastic tanks have not been constructed in the past, is the difficulty of operating and constructing the tanks under field conditions. Water tanks, for example are often built in deserts, mountaintops and away from the pristine and controlled conditions of the laboratory. Resins are commonly delivered with promoters for a certain fixed temperature, normally room temperature. However, in the field, temperatures will vary substantially. Certainly, variations from 32° F. to 120° F. may be expected. These conditions mean that the percent of additives for promoting the resin and the percent of catalyst for the chemical reaction, which will vary widely under those temperature variations, need to be adjusted constantly for the existing air temperatures. Considering that these percentages are small compared to the volume of resin, accurate metering and mixing is required which presents a major hurdle to on-site construction of fiber-reinforced plastic.

Turning now to the seismic anchoring aspects of the present invention, in conventional concrete tank construction, methods used to compensate for earthquakes and other tremors have includes built-up wall thicknesses, and seismic cables anchoring the walls of the tank structure to the footing upon which the walls rest. These seismic cables typically allow limited horizontal movement between the walls and footing in the hope of dissipating stresses. Since tanks typically rest on a circular concrete ring or footing reinforced with standard steel reinforcement, the seismic cables are encased in the concrete footing. In most instances, the seismic cables are encased in sponge rubber sleeves where they exit from the footing (also called a foundation) into the walls at angles varying from 30° to 45° with the horizontal surface of the footing. The other end of the seismic cables are then encased in the concrete walls of the tank. The walls of the tank typically rest on a rubber pad placed between the wall and the footing. This placement allows the walls to move radially in or out in relation to the footing to minimize the vertical bending stresses and strains caused by circumferential prestressing, filling or emptying of the tank, or by horizontal forces caused by earthquakes or other earth tremors. In many instances the cables connect the wall and the footing prior to the addition of circumferential prestressing. This earlier means to compensate for seismic and other forces can be seen by its very description to be very complex and ineffective especially for a given cost.

SUMMARY OF THE INVENTION

The present invention is directed to improved tank structures and the processes and apparatus for their construction.

In a first aspect of the present invention, a prestressed tank is disclosed with the walls formed by inflating a membrane, applying one or more layers of rigidifying material outwardly of said membrane and then prestressing the walls by circumferentially wrapping prestressing material to minimize the tension in the rigidifying material when the tank is subjected to loading.

In another aspect of the invention, the preferred embodiment utilizes wall forms placed inwardly of said membrane to aid in the circumferential prestressing and forming of the walls.

In the best mode of the invention, the walls are of reinforced plastic, fiber-reinforced plastic or resin sandwich composite construction. Another aspect of the invention utilizes vertical or radial prestressing outwardly of said membrane in conjunction with said circumferential prestressing. The subject invention, utilizing a membrane in conjunction with circumferential prestressing and the other claimed features, results in substantial function and cost advantages over the conventional tanks previously discussed. Using the means set forth by this invention, a process can be employed to substantially reduce the thickness of walls and roofs of fiberglass tanks. The automated means of construction recommended can substantially facilitate construction and decrease the costs for a large variety of tanks for water, sewage, chemicals, petrochemicals and the like.

Another aspect of the present invention, are the seismic countermeasures used to protect the contemplated structure against earthquakes and other tremors. To eliminate instability or possible rupture, the tank walls are anchored to the base through seismic cans. The cans are preferably oriented in a radial direction in relation to the center of the structure, permitting the seismic forces to be taken in share by the seismic anchors. The walls of the structure are free to move in or out in the radial direction allowing the structure to distort into an oval shape thereby minimizing bending moments in the wall. Thus, when a seismic disturbance occurs, the force acting on the structure can be transmitted and distributed to the footing and around the circumference of the tank.

BRIEF DESCRIPTION OF THE DRAWINGS

FIG. 1 shows a cross-sectional view of a circular composite structure, containment vessel or tank which comprises the best most of the subject invention.

FIG. 4 is a cross-sectional blow-up of the inner and outer concrete rings.

FIG. 5 shows a blow-up of a seismic can with the seismic bolt slidably in place.

FIG. 6 shows a radial elevation of a seismic can showing how the head of the seismic bolt is constrained by the slot, groove and shoulder in the seismic can.

FIG. 7 illustrates the shear resistance pattern from the seismic anchors with the direction of seismic forces being in the north-south direction.

FIG. 10 is a cross-section taken along section A—A in FIG. 9 showing a top view of the seismic bolts, aluminum angles used to hold the inner membrane in place, aluminum channels, fiber reinforced resin laminate walls and outer prestressing.

FIGS. 22, 23 and 24 depict the construction of openings in the walls or dome of a composite tank in accordance with the subject invention.

DETAILED DESCRIPTION OF THE PREFERRED EMBODIMENTS

Turning first to the drawings, FIG. 1 shows the basic tank configuration with a dome roof. The tank of course may also be built as an open top tank. In that case, additional stiffening prestressing may be required at the top of the wall. The dome in FIG. 1 is elliptical in shape and can be approximated by two cylinder curves. In the best mode, the small radius equals 1/6 of the wall radius and covers an arc of 62° with the horizontal. The large radius covering an arc of 56° centered on the vertical center line of the tank, equals 1.941712 times the wall radius. By example, the wall height shown on FIG. 1 is 32'6 and the high liquid depth (HLD) is two feet above the wall-dome transition point. Of course the liquid depth may well vary depending on the conditions within the tank. The tank radius for a 2 million gallon tank may be 50° in which case the height of the wall is nominally 32'6". The thickness of the floor may be 0.375". The approximate thickening of floor to wall corner may be 2.25"×2.75". The dome roof of the tank is defined by 2 radii of curvature: for the first 62° with the horizontal this is 8'4" and for the remainder of the dome this is 97'1."

Figure 2:
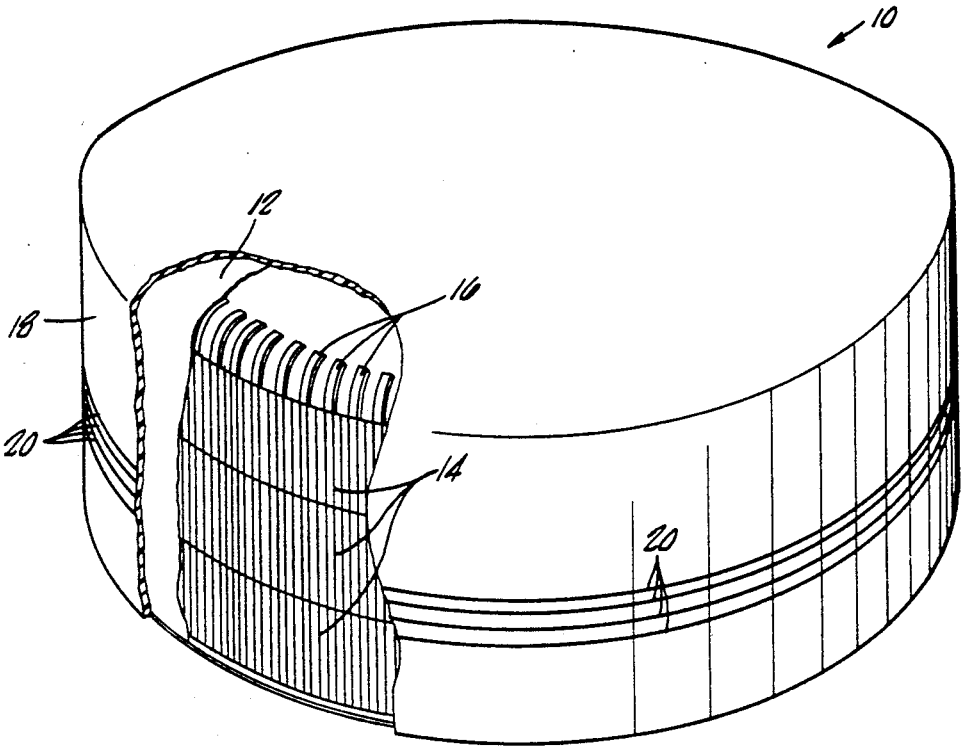
FIG. 2 shows an elevated view of the tank which is cross-sectioned to reveal the infrastructure during construction. The composite walls of the tank are cut away to reveal the outside fiberglass/resin/laminate (FRP) structure.

FIG. 2 is a cut-out of the tank during construction prior to the inner membrane and wall forms being removed. The construction sequence is briefly as follows. First the inner membrane is anchored and inflated. If desired, radial prestressing in accordance with FIGS. 25–27 may be added, although this embodiment is not shown in FIG. 2. Then, wall forms are assembled adjacent and within the inner membrane to give further support for the later application of rigidifying material (RM) on the outside of the membrane. A plurality of straight wall forms 14 are used. (These are aluminum channels in the best mode). Curved wall forms 16 can also be used if further support and accuracy in constructing the dome is desired. After the wall forms and inner membrane have been assembled, the composite wall 18 is constructed by appropriately spraying fiber reinforced plastic (FRP) and sand-resin (SR) layers in varying proportions depending on the type of laminate structure desired. Thereafter, circumferential prestressing 20, utilizing pretensioned wire or the like is applied by wrapping around the tank. This prestresses the walls and places the composite wall material 18 in compression. The circumferential prestressing will also place the wall forms 14 in compression. For that reason, it is desirable to have the compressibility of wall forms 14 such that they will readily move in or give, so reducing the tension in the wrapped wire. In the best mode, the modulus of elasticity of wall form 14 and composite wall material 18 is substantially less than the modulus of elasticity of the circumferential prestressing material 20. Therefore, a relatively small inward movement of the wall form 14 will substantially reduce the tension in the circumferential prestressing wire 20, which in turn will cause a substantially lower compressive stress in the wall form 14 and composite wall material 18, which in turn will reduce weight and cost of the forming material 14. Upon completion of wrapping under tension and encasing the wrapped material 20 in resin, sand-resin or fiber reinforced resin, the wall forms 14 and 16 are removed. This places the composite wall 18 in further compression. The low modulus of elasticity of the composite wall 18, compared to the wrapped material 20 is very beneficial since a relatively small motion of the wall results in a large reduction of tension in the wire and a relatively small increase of compression in the composite wall 18. This serves to minimize the buckling potential of the composite wall 18. In the best mode, the prestressing material will typically be steel wire. However, the wrapping material can also be in whole or in part of glass, asbestos, synthetic material or organic material in filament, wire, band strand, fabric or tape form.

After circumferential prestressing is applied and wall forms 14 and 16 are removed, the compressive strain in the tank wall (under tank empty) could be in the order of 0.2 to 0.3 percent. The reason why this initial compression is so important is the need to overcome the tensile stress limitation of 0.1% strain set by the various current codes for FRP materials (Of course the principles herein are adaptable to the full spectrum of stress limitations, but for the sake of example, we focus on the current codes). When the tank is subjected to a load when it is filled with water or other liquid, the prestressing wires will increase in tension, while the composite wall 18 will reduce in compression and subsequently go into tension by virtue of outward forces exerted by the full tank on the walls. The required amount of wire is such that equilibrium in the combined wire and composite wire tension is found with the bursting force, due to the liquid pressure, when the tension in the composite wall 18 equals 0.1% strain.

For purposes of this disclosure, rigidifying material is defined as a variety of materials including solid fiber reinforced plastic (FRP) or an inner and outer layer of fiber reinforced plastic combination, with the middle layer being resin sand-resin, or other material. The purpose of the middle sand-resin layer is to provide a low cost thickening of the wall to lower the compressive stress and to improve the resistance to buckling. Typically, the layers of fiber reinforced plastic, especially the inner and outer layers, may be reinforced by multidirectional short fibers made of glass, steel, synthetics, organics or asbestos. Another form of prestressing the composite wall in addition to steel wire is woven fabric made from glass fibers, steel fibers, nylon fibers, organic fibers or synthetic fibers. The rigidifying material typically also can contain resin such as polyester resin, halogenated polyester, Bisphenol-A Fumarate resin, vinyl ester, isophthalic resin or epoxy resin and the like. It is also important to keep in mind that a second means of increasing the load carrying capacity of the fiber reinforced plastic is to replace the glass fibers with phosphoric-acid-coated hot-dipped galvanized or stainless steel fibers. The modulus of elasticity of steel fibers is about 2.75 times that of glass. Accordingly, a fiber reinforced plastic made of polyester resin reinforced with steel fibers will have a modulus of elasticity that is about twice that much compared to polyester resin reinforced with glass fibers based on the same fiber content, for example, 15% by volume. This means that a fiber reinforced plastic made with steel fibers will be able to withstand twice the tensile load of fiber reinforced plastic made with glass fibers, based on the same tensile strain. If one considers pretensioning of fiber reinforced plastic to 0.1% compressive strain only, while permitting only 0.1% tensile strain as required by known codes, combined with the effect of steel fiber reinforcing, it is noted that there will be an increased capacity of over four times the conventional tensile load for the same thickness of fiber reinforced plastic reinforced with glass fibers. For a 0.2% compressive strain allowance, this would offer eight times the conventional tensile load for the same thickness of fiber reinforced plastic. Substantial savings in the use of fiber reinforced plastic can therefore be obtained by using steel fibers in lieu of glass fibers.

It is important to note that pretensioning of the wall may be done prior to or after removal of the wall forms. Pretensioning after removal may substantially increase the potential for buckling the fiber reinforced plastic walls since the wrapped wire will not be bonded with resin to the fiber reinforced plastic wall during the pretensioning process. Therefore, the recommended procedure is to pretension the wires on the composite wall 18 when the composite wall is supported by the wall forms 14. In this regard, it is recommended to pretension against a form material with a modulus of elasticity substantially lower than the material used to crease the circumferential prestressing which, in the best mode, is wrapped steel wire. Accordingly, the best practice is to use light aluminum support channels for the wall forms. Aluminum forms will be able to move and give under prestressing, lowering the compressive stress in the aluminum. Moreover, use of aluminum will eliminate the use of very heavy forms which are hard to work with, assemble and disassemble within the confines of the inner membrane.

Figure 3:
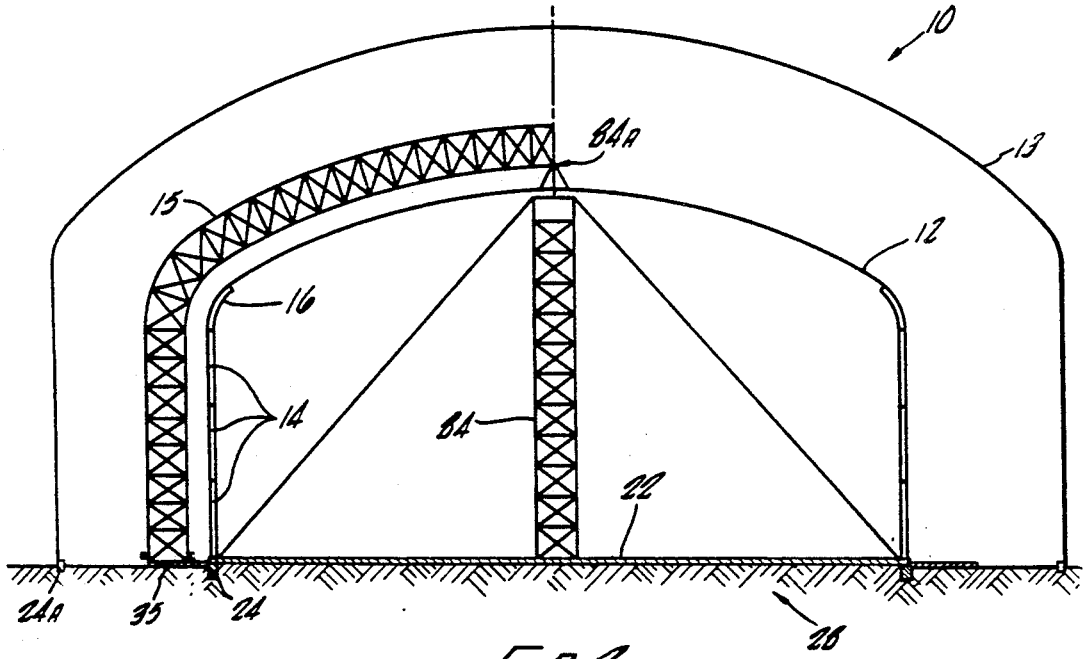
FIG. 3 shows a side view of the tank illustrating the shape of the inner and outer membranes.

Turning now to FIG. 3, there is illustrated a diagrammatical sketch of the positioning of the outer membrane 13 outside of the inner membrane 12. The outer membrane is generally of the same shape as the inner membrane except that it is much larger to clear the revolving spraying and pretensioning equipment shown diagrammatically as the curved tower structure 15 on the riding pad. The outer membrane is also needed to protect the spraying and curing operations from the weather. The inventor contemplates the best mode of practicing this invention by utilizing automated spraying and pretensioning equipment such as that set forth in detail in U.S. Pat. Nos. 3,572,596; 3,666,189; and 3,869,088 and in the brochure which is attached to Exh. A to the disclosure statement filed herewith. Generally, the wrapping and spraying equipment is mounted on a tower structure 15 which travels on the riding pad 35 located around the inner tank footing. The revolving tower 15 may be temporarily supported by center tower 84 anchored by cables to the ring footing. The equipment thus revolves around the tank spraying the proper amount of fiber reinforced plastic and sand resin, and, in a later operation, winding steel wire under tension around the tank followed by encasing the steel wire in resin, sand-resin or FRP material. The outer membrane is needed to protect these operations, especially the spraying and curing operations of the rigidifying material, from the fluctuating weather conditions. The inner and outer inflated membranes are held down from the uplift forces by circular concrete rings 24, 26 anchored to the ground. FIG. 3 shows the inner concrete ring 24 serving as a fixed base for anchoring the inner membrane 12 and the outer concrete ring 26 anchoring the outer membrane 13. The floor of the tank is also fiber reinforced plastic but is preferably separated from a thin concrete leveling pad 22 by polyethylene sheeting (not shown). The concrete leveling pad is supported by a compacted subgrade 28 having a preferable minimum density of 95%.

The inner and outer concrete rings, as well as the seismic anchors contained therein are shown in detail in FIGS. 4, 5 and 6. The floor-wall corner is reinforced with stainless steel (floor ring 38 and retainer ring 40, see FIGS. 9 and 15) and additional layers of fiber reinforced plastic or resin). Stainless steel seismic bolts 31 moveably connect the walls by anchoring the walls into stainless steel seismic cans 30 built into the inner concrete ring 24 which serves as a fixed base for holding the seismic cans. The shape of the seismic cans 30 is not critical. The cans 30 can be rectangular, circular, oval or any other shape as long as they allow the seismic bolts (which anchor the walls) to move radially. These bolts 31 also anchor the inner inflated membrane. The seismic bolts are shown by number 31 in FIGS. 4, 5, 6 and 9 while the seismic cans which anchor the bolts (but which allow the bolts to travel radially in slots and grooves and on shoulders in relation to the tank) are shown by numeral 30. The bolts 31 are themselves anchored by seismic cans 30, which are constructed to allow the bolts 31 to travel radially in grooves 32B (in the horizontal direction). The vertical restraint is provided by slotted shoulders 32A which act against the head 31C of the seismic bolt. A washer 31D may also be used. The combination of the bolts 31 moving in the slots 31B and grooves 32A comprise the slot and groove assemblies. The seismic bolts 31 are able to move radially in and out to relation to the center of the tank in the slot provided in the seismic cans 30. The head 31C of each bolt 31 rests on the stainless steel shoulder 32 encased in the reinforced concrete ring. These bolts can therefore accept uplift forces acting on the tank. Since there is little clearance between the bolts and the seismic cans, the wall and the slidably attached floor is permitted to move radially in or out in relation to the center of the tank, while being limited in vertical movement by the downward force provided by shoulders 32. The diagram of the inner concrete ring 24 in FIG. 4 illustrates this embodiment in further detail. The inner concrete ring in this instance is rectangular in cross section, and reinforced vertically with stirrups 33, and circumferentially with regular reinforcing bars 34 adequately aligned to transfer tensile forces. The number, spacing and sizes of these reinforcing bars will depend on the forces acting on the inner concrete ring caused by uplift and shear forces acting on the seismic cans and the depth and width of the ring. FIG. 4 relating to the inner concrete ring also shows the riding pad 35, also reinforced, upon which the tower rides which supports the spraying and precision prestressing machinery. The seismic bolts 31 (shown protruding from the seismic cans) anchor the reinforced lower portion of the composite walls 18 (and the floor) to the inner concrete ring which forms part of the base of the tank. The left portion of FIG. 4 shows the outer concrete ring 26 whose sole function is to anchor and support the outer membrane, which provides shelter from the elements during construction.

FIGS. 5 and 6 show detailed cross sections of the seismic anchor cans 30 moveably holding the seismic bolts 31. FIG. 6 shows a cross section of the seismic can taken in a radial direction (arrows in FIG. 6) and illustrates how the head 31C of the bolt 31 is able to slide radially in the slot 32A and the groove 32B while resting on shoulder 32 of the seismic can. The end of the bolt protrudes upwardly out of the seismic can and is used to anchor the membrane and ultimately the walls of the tank/floor connection. The inner concrete ring serves as a wall footing to distribute the wall and roof loads to the ground, as well as serving as an anchor for seismic loads acting on the tank and its contents, and as the hold down anchor for the inflated membrane, whether it be removable or permanent. The seismic anchor cans are cast on this inner concrete ring in a manner that the one inch seismic bolts (in the preferred embodiment), can freely slide radially. Circumferentially, the bolts are locked in the seismic anchor cans and concrete ring and thereby are able to distribute parallel to the wall, those horizontal seismic forces acting on the tank (and on the liquid in the tank) (See arrows in FIG. 7 indicating the direction of the forces). Furthermore, the bolts can also hold down the tank or membrane against vertical uplift forces from wind or seismic loads on the tank or from inflation pressures on the membrane.

To better illustrate the function of the seismic anchors we now turn to FIG. 7 which sets forth a shear resistance pattern for the seismic anchors. For purpose of illustration and not as a limitation, we use 8 seismic anchors located so that the seismic bolts can move radially towards and away from the center of the tank. If one were to assume that the direction of the seismic forces is North (0°) to South (180°) as shown in FIG. 7, the points of minimum shear are at 0° and 180°, or the North and South points, and the points of maximum shear are at 90° and 270°, or at the East and West points. Shear triangles are depicted in the upper left hand portion of FIG. 7 illustrating how shear value 90 diminishes from the maximum at 90 degrees or (270°) to the minimum at 0° (or 180°). If, for example, there is an earthquake, storage or other load acting in the north-south direction on the tank walls, these loads will be restrained by the seismic bolts in shear on the east-west side of the tank. The maximum loads will be at the true east-west points gradually diminishing to zero at the true north-south points with the change of the sine value. If we assume that these forces act in the northerly direction, the components of the forces concentric to the wall or concrete ring, acting between the bolts and the seismic cans in the inner concrete ring, cause the inner concrete ring to drag on the soil inside the ring on the south—which in turn causes a shear in the soil at the bottom elevation of the ring. This is essentially the same condition although probably varying in magnitude, as depicted in FIG. 7. Thus the tensile force in the inner concrete ring will be lessened by the compressive forces of the soil on the north side resisting orderly movement of the inner concrete ring. Of course, the seismic anchors need not be aligned exactly radially but can be aligned at different angles as long as the seismic forces are distributed. However, as the deviation from the radial position increases, so will the vertical bending and diagonal shear stresses in the wall increase, requiring an increasingly thick wall. It is also noted that circumferential tension forces in the inner and outer concrete ring footings 24 and 26 (FIG. 4) can develop for several conditions other than those seismic in nature. For example, a bursting force can be created by radial expansion of the soil inside the inner concrete ring resulting from the liquid load pressing on the tank floor and the ground below it.

Figure 8:
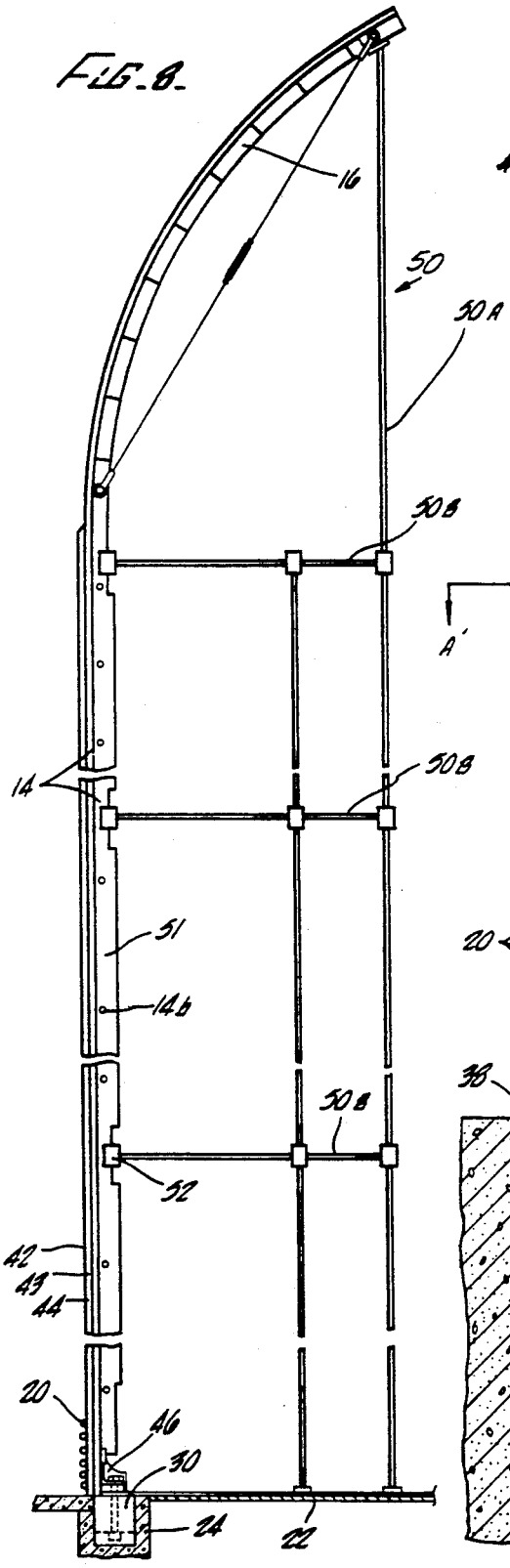
FIG. 8 shows a side view cross section of the tank during construction illustrating how the combination of channels and membrane are used to support and form the walls of the tank.
Figure 9:
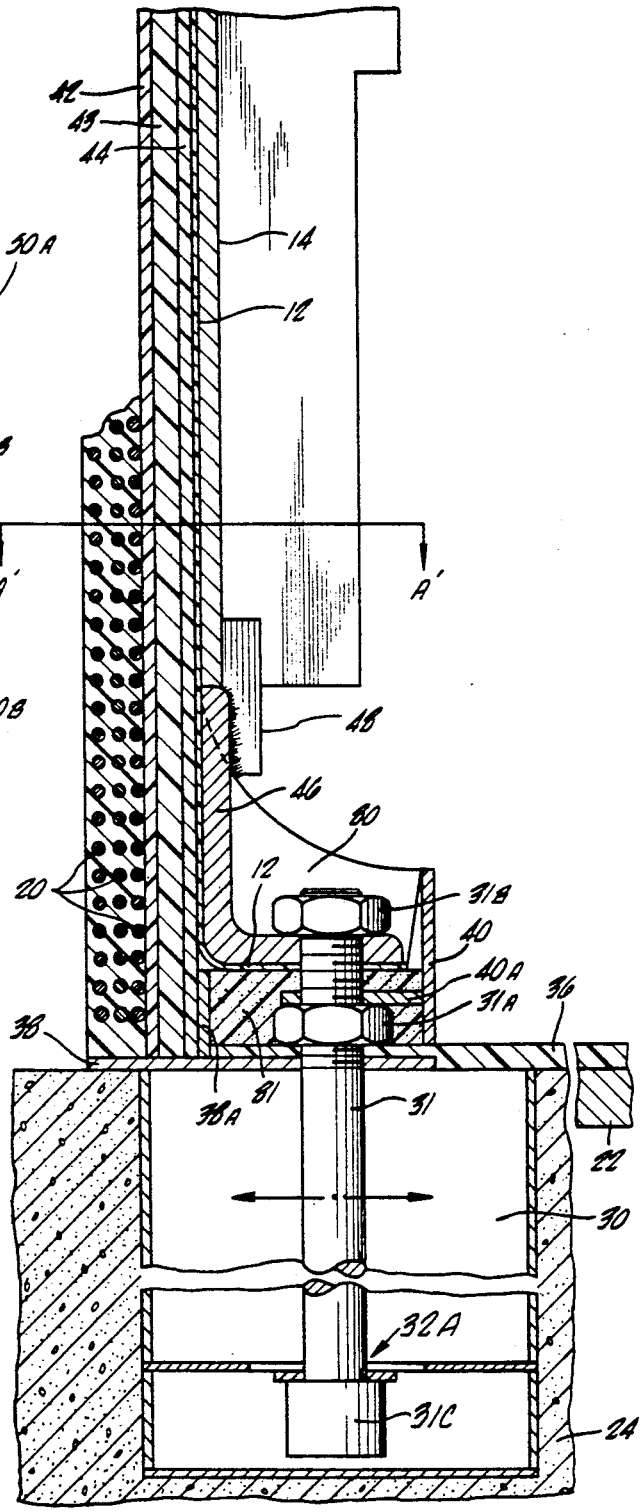
FIGS. 9 and 10 show the lower wall and base of the tank during construction.
Figure 10:
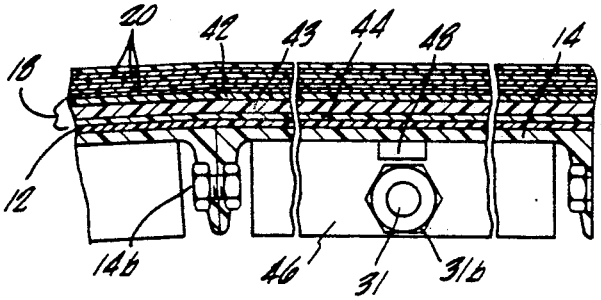

Turning now to FIGS. 8, 9 and 10, we see how the floor and walls are constructed on the inner concrete ring 24 and anchored by the seismic bolts 31, moveably connected to the seismic cans 30 which are in turn embedded in the inner concrete ring. Focusing on FIG. 9, a stainless steel floor ring 38 having an upraised flange **38*a* welded thereto, is constructed to form a ring of stainless steel resting upon the inner concrete base ring 24 and pad 22. The flange 38A is used in part to seal, in part to contain fiber reinforced plastic sprayed therein, and in part to butress the walls of the tank especially when prestressing is applied. The stainless steel floor ring 38 contains apertures through which the seismic bolts 31 are threaded. The floor is constructed so that it partially overlaps this stainless steel floor ring. The tank floor 36 can either be solid fiber-reinforced plastic or can consist of a variety of layers including layers comprising of: (1) a bottom layer of fiberglass of, say, 3/16 inch thickness; (2) a middle layer of sand-resin, the thickness of which depends on the need for having a heavier floor; and (3) a top layer of fiberglass of, say, 3/16 inch thickness. The fiberglass floor is supported by the concrete leveling pad 22** and preferably separated by a layer of polyethylene (not shown). This prevention of the fiberglass from bonding to the concrete is preferable because the capability of the floor to slide in relation to the concrete pad is helpful in that the floor will initially want to shrink inward during the spraying process and subsequently want to stretch outward when the tank is filled. Accordingly, reduced friction between the concrete and the polyethylene is useful in minimizing stresses.

Upon completion of the fiber-reinforced plastic floor, bottom nuts 31A are screwed on to the seismic bolts to nominal finger tightness. It is important not to tighten these nuts too much because relative movement between the floor, the stainless steel floor ring, and the inner concrete ring is desired. Thereafter, a stainless steel retainer ring 40, with radial anchor lugs 40A welded thereto at the anchor bolt locations, is threaded on the seismic bolts and tack welded to the nuts 31A. The retainer ring 40 circles the circumference of the tank forming a trough 41 in relation to the floor ring 38 and flange 38A. The trough is then filled with fiber reinforced plastic (FRP), or sand resin 81 to form a seal. For the reasons before mentioned, the connection between floor ring 38 and inner concrete ring 24 must not be too tight because once the prestressing takes place, the wall and the aluminum form is caused to move inwardly toward the center of the tank tending to take the floor and edge reinforcing with it. This will set up a stress pattern in the wall if no relative movement is allowed. Once the sand-rein or fiberglass fill has been deposited, the preshaped inner membrane 12 can be connected to the seismic bolts 31. The membrane is held firmly affixed to the seismic bolts by the utilization of temporary membrane retainer angles 46 which are bolted down to the sand-resin fill 81 with nut 31B. To insure vertical alignment of the exterior surfaces of the wall form channels 14, retaining brackets 48 projecting from the top of the angle 46 are welded to the inside surface of the angle at approximately 12" on centers. The aluminum angles have flanges permitting them to be bolted together so as to form a continuous support structure with its lower portions fastened to the angles attached through the seismic bolts to the circular ring footing 24. Therefore by utilizing angles 46, there will be no need for circular trusses to support the formwork at the bottom of the wall.

Figure 11:
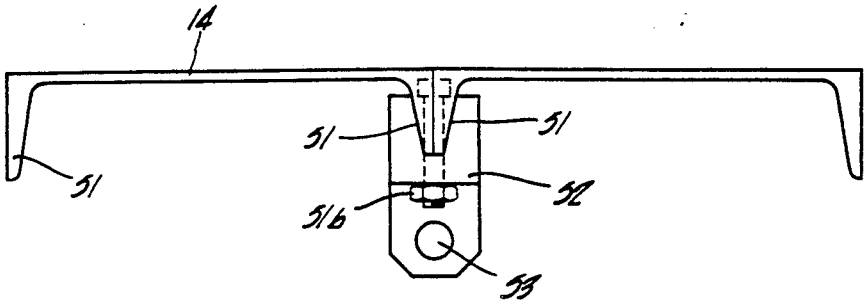
FIGS. 11 and 11B show various views of the truss connection, support channel sections and block.
Figure 11B:
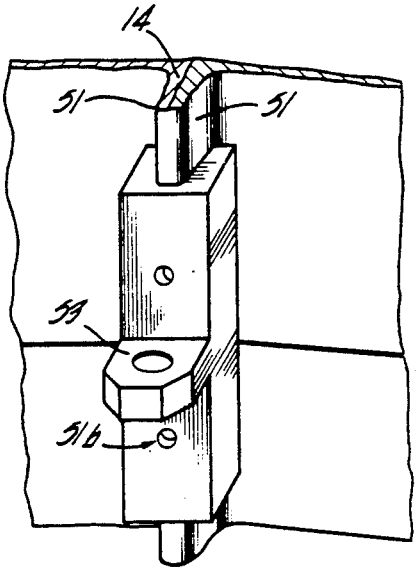

Once the membrane retainer angles 46 holding down the membrane 12 have been fixed in placed, the membrane can be inflated thus defining the shape of the dome. Thereafter, an interior wall form (aluminum channels 14) can be used as needed to further support and align the inner membrane. The aluminum channels are bolted together in a manner shown in FIGS. 10, 11 and 11B. The assembly rests on the membrane retainer angles 46 (FIG. 9) aligned by form retainer brackets 48 welded on the angles. As many rows and columns of aluminum channels as needed will be used to form the wall. FIG. 8 illustrates a series of three straight aluminum channels 14 topped by curved aluminum channels 16. The upper curved and intermittently spaced aluminum channels are supported by posts 50A and attached braces 50B connected to truss system 50—shown in more detail in FIGS. 12, 13 and 14. By way of example, three vertical lengths of channels 14 could form a wall height of say 37.5 feet. As noted above, the first level of vertical channels 14 are held in place at the bottom by the membrane retainer angle 46 located near the membrane anchoring point.

Figure 12:
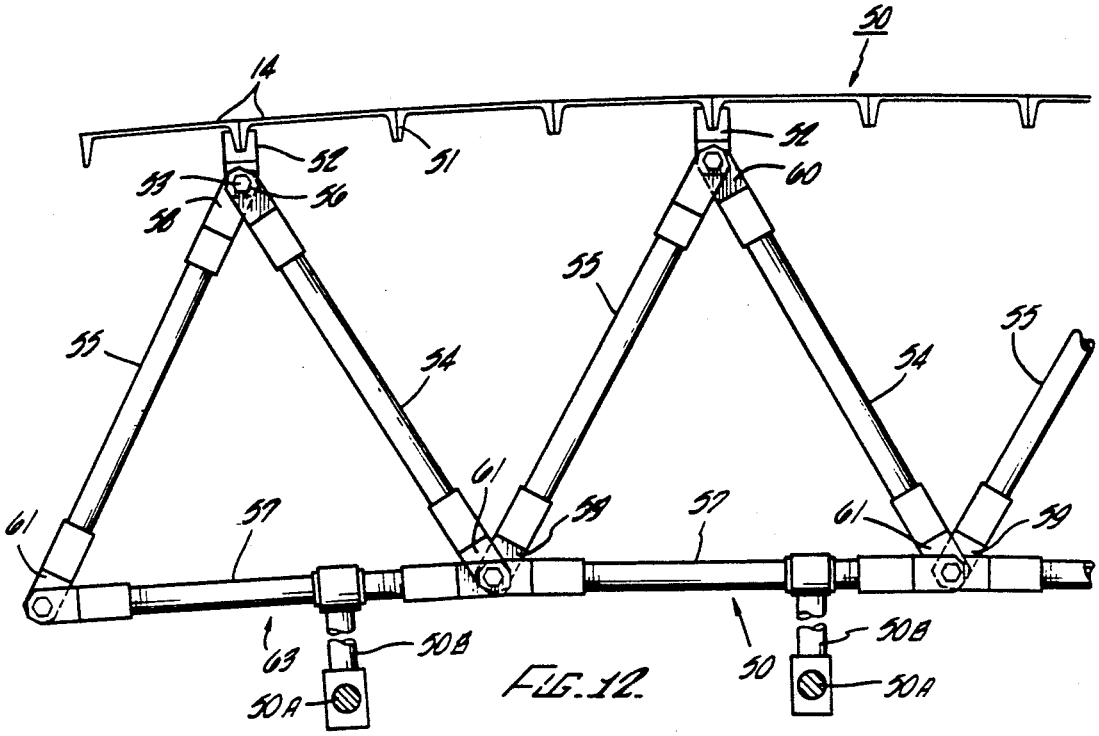
FIG. 12 shows the down view of a portion of the circumferential truss network emphasizing the inner connection of the truss used to support the channels support assembly.

Since a second level of channels 14 requires lateral support, a network of trusses 50 as shown in FIGS. 8, 12, 13 and 14 is employed. FIG. 12 shows how the vertical channels 14 are supported by a network of trusses which form an infrastructure in the tank. The truss network is constructed by fitting the flanges 51 of adjacent channels 14 with clamps 52 which are attached to the flanges 51 by bolts **51*b* or other fastening means. Clamps 52 may be centered on the horizontal joint between two vertical flanges 51 of channels 14 (FIGS. 11B and 8) or they may be used at the top of the wall as shown in FIG. 8. The clamps are fitted with vertical bolt holes 53 to facilitate attachment of the radial truss members 54 and 55. The radial truss members 54 and 55 are attached to each clamp 52 by a bolt 56 passing through the ends of the radial truss members 54 and 55 which are fitted with coordinating bolt holes, and through the bolt holes 53 in the clamp 52. In between clamps 52, flanges 51 of channels 14 are clamped together with bolts 14*b* which may be seen in FIG. 8, 10 and 11**.

Figure 14:
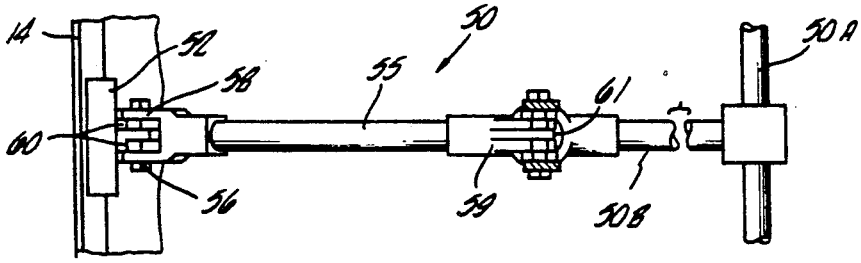
FIG. 14 shows a radial view of the truss connection with the aluminum channel.

The radial truss members 54 and 55 employ two different interlocking means for attachment to the clamps 52 and circumferential truss members 57. As shown in FIG. 14, one radial truss member 55 has a wide two-pronged interlocking configuration 58 on the end attached to the clamp 52, and a narrow single-pronged interlocking configuration 59 at the connection point with the circumferential truss member 57. The second diagonal truss member 54 (hidden except for interlocking means in FIG. 14) has a narrow two-prong interlocking configuration 60 bolted to the clamp 52, and a narrow two-prong interlocking configuration 61 at the connection point with the circumferential truss members 57.

Figure 13:
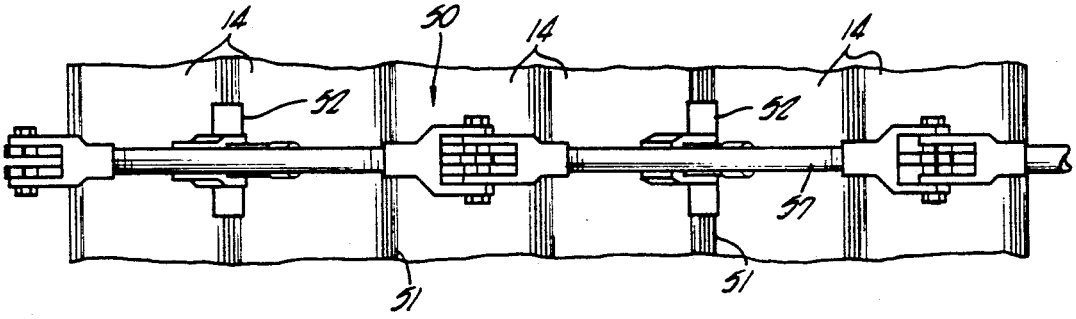
FIG. 13 shows the inside view of a circumferential truss network connected to the channel assembly used in constructing the walls.

As shown in FIGS. 12 and 13 the first and second diagonal truss members 54 and 55 are attached to each clamp 52. The truss diagonal members 54 and 55 are positioned diagonally such that the first truss member 54 meets the second truss member 55 from the adjacent clamp 52 at a point interior to the channels 14 which form the wall supports for the tank. Circumferential truss members 57 are then placed such that each end of the truss 57 meets with the convergence of adjacent diagonal truss member 54 to form an inner circular truss 50 supported by posts 50A and attached braces 50B. Truss members 57 have two-prong threaded connection means between the rod and the end blocks to facilitate their interconnection. Preferably, the above-described truss network is employed at the top of each length of channel 14. Thus, in a typical tank where three lengths of channel are used (FIG. 8), three truss networks overlaid one on the other, will be used.

Once the form work has been erected, the walls are ready to be constructed. It is important to note that FIGS. 8, 12, 9 and 10 show an aluminum wall form consisting of channels and FIGS. 8 and 12 show circumferential trusses which are erected on the inside of the inflated membrane to offer support for, and better alignment of, the membrane and the walls formed on the membrane.

Tank walls can either be made of solid fiber-reinforced plastic or, as shown in FIG. 9, can consist of a sandwich-type composite construction where the inside layer is fiber-reinforced plastic, the middle layer is sand-resin and the outside layer is fiberglass. Combinations of such layers of the same or different materials can, of course, also be used. After the walls are constructed, they are then prestressed by being wrapped circumferentially with high tensile wire, (for example of 0.196" diameter) designed to contain the bursting forces predicted under the loading conditions of the tank. The circumferential prestressing wire 20 shown in FIGS. 2 and 9 can be hot-dipped galvanized or stainless steel at close wire spacings. Spaces in between the wires can be filled with polyester resin, sand resin, fiber-reinforced plastic or a combination thereof. For large wire spacings the spaces may be filled with a sand-resin mix or fiber-reinforced plastic. For close wire spacings pure resin may be used. A fiberglass reinforced resin may be also used as an outside covering over the wires to prevent cracking of the resin along the wires. When more wires need to be placed per foot height than is physically possible under the minimum wire spacing requirement, one or more additional wire layers may be used. In accordance with the embodiment in FIGS. 25, 25A and 26, it may also be desired to utilize vertical or radial prestressing which may include spacers or hooks 101 and stabilizing bars 102 which interlink with the circumferential prestressing and can prevent it from riding up on the structure.

The amount and type of prestressing is, of course, a function of the design and anticipated loads of the tank or containment vessel. Although the bursting forces for the liquid loads contemplated should diminish linearly to small values near the top of the wall, additional prestressing may still be needed at that point depending on the design. Although it is customary for prestressed concrete tanks to wrap all wires under the same tension, for reasons of convenience it should be kept in mind that wrapping machinery such as that shown in U.S. Pat. Nos. 3,572,596; 3,666,189; and 3,666,190 is capable of providing, instantaneously and electronically, any higher or lower stress than the standard stress level adopted by the design. This adjustment may be desired to minimize vertical bending stresses particularly near the bottom or the top region of the wall.

Of course, wrapping of the walls with tensioned wire will cause an inward motion of the fiber-reinforced plastic walls and the supporting aluminum wall form. The inward motion will lower the initial applied force on the wire and an equilibrium during each wrapping will develop when the combined compressive forces in the aluminum wall forms and those in the fiberglass wall, will equal the inward but reduced radial wrapping forces. Likewise, the steel reinforcing (e.g. floor ring and flange 38 and 38*a*) and the sand-resin fill in the corner ring at the wall/floor juncture and, of course, the floor itself will also resist the inward motion during wrapping. As stated, each layer of wrapped wire 20 is covered with resin or sand-resin before the next wire layer is started. After the final layer of wire has been wrapped, the wire will be covered with resin, sand-resin or fiber-reinforced plastic reinforced resin. The resin should have developed its design strength by the time wrapping of the new wire layer has started. Accordingly, each resin or sand resin layer will contribute to the compressive and subsequent tensile strength of the wall. It would therefore facilitate the wall economy when the outer wire layer contains as many wires as possible, subject to the minimum wire spacing requirements. The next outermost wire layer should then be filled to its capacity before another wire layer is added inward of that layer.

After installation of the rigidifying material and the wire wrapping application on wall or dome have been completed and the exterior wire 20 has been covered with resin, sand-resin, or fiber-reinforced plastic reinforced resin, the aluminum wall form 14 retainer angles 46 and trusses 50 can be removed. The membrane 12 can be deflated and, if desired, the membrane 12 itself can be removed. This can be expected to cause the fiber-reinforced plastic wall to further move towards the center, thereby further lowering the stresses in the wires until a new equilibrium is reached by the compressive stress in the fiber-reinforced plastic wall and the remaining radial forces in the wire. In accordance with the recommended design, compressive stress should not exceed a predetermined value of buckling may occur.

Figure 15:
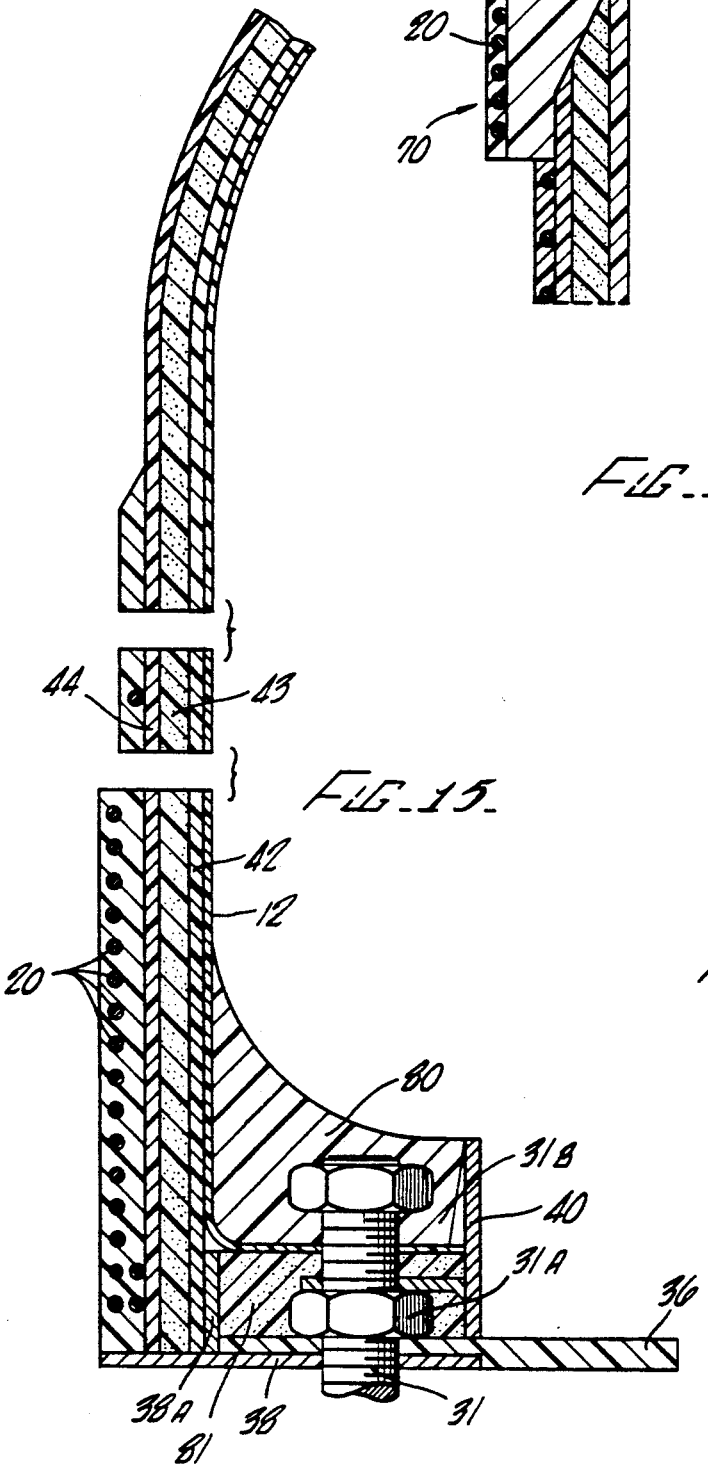
FIG. 15 shows a detailed cross section of the wall-floor assembly in its completed state with the aluminum channels retainer angle and truss network removed.

After removal of the inside wall forms 14 and membrane (if the membrane is not to be incorporated in the wall or sandwiched within the wall by an interior layer of rigidifying material) the corner floor-wall juncture can be completed. As shown in FIG. 15, this entails: filling the upper half of the trough created by retainer ring 40 and floor ring 38 and 38*a* with fiber-reinforced plastic or FRP 80 to approximately the underside elevation of the top nut 31*b*, installation and tightening of the nut 31B to the fiberglass, and filling the remainder of the trough in the completed corner with fiber-reinforced plastic 80 or FRP. Indeed, FIG. 15 is a diagram of the cross section of the corner wall-floor connection with the interior truss work and aluminum channel support forms removed.

Upon completion of the floor-wall junctions and the remainder of the tank, the tank is then filled with water for the initial test and, if the results are positive, it is filled to capacity with its final contents. Upon filling, the liquid pressure will of course urge the wall to move outwardly. In fact, the initial applied radial stress in the wire which subsequently is reduced by the inward motion of the wall upon the application of circular prestressing forces, should offer a force smaller than the bursting force or loads acting on the wall when the tank is filled to capacity. This is done purposely to minimize the compressive stresses initially applied to the fiberglass wall and the aluminum form and wall trusses. Therefore, when the full liquid load is applied, there will be an increase in the stress of the wire 20 beyond the initial stress until equilibrium is found. That increase in the wire stress will cause the composite wall material 18 to go into tension. (See FIG. 2) That tension is to be limited to a strain in the composite wall material 18 of 0.1 percent (or other value needed in order to comply with applicable codes). The maximum stress in the wire, together with the maximum stress in the composite wall material 18 therefore corresponds to the maximum bursting force of the liquid. That maximum stress in the composite wall material 18 will be limited to the above maximum permissible tensile strength of 0.1 percent. A 0.1 percent strain in the composite wall material 18, for example, will also mean a strain increase of 0.1 percent in the wire beyond the initial applied stress during wrapping which equals to a stress increase in that wire 20 of 0.1 percent of the modulus of elasticity of that wire. Therefore, the initial applied stress in the wire 20, before being subjected to stress losses resulting from the inward movement of the wall upon the application of circumferential prestressing, should equal the maximum wire stress under full liquid load, less the maximum permissible stress increase from that 0.1 percent strain increase as limited by the codes.

Returning to the membranes contemplated in the best mode of the invention, in this case, a vinyl coated polyester fabric can be used that will not adhere to the fiber-reinforced plastic sprayed thereupon. This will enable the removal of the membrane upon completion of the wall and dome if desired. Two types of fabrics are currently under consideration; both of which are sold under the tradename SHELTER-RITE (a division of Seaman Corp.) style 8028 which has a tensile strength of 700/700 psi and Style 9032 which has a tensile strength of 840/840 psi. Both fabrics presently are available in rolls 56" wide and 100 yards long. Two terms are commonly used to describe properties of these membranes which must be taken into account in tailoring the membrane: "warp" which is the length direction of the roll, and "fill" which is the width direction of the roll. In order to make cylindrical and dome shaped membranes, the fabric must be cut, shaped, and spliced to a pattern (in its unstressed condition) based upon the anticipated and of ten different elongations of the membrane in the "warp" and "fill" directions after inflation. As referenced in FIGS. 2 and 3, this inner inflated membrane 12 is used to provide an economical dome form. Furthermore, the application of a correct coating on the membrane will serve as a bond breaker for the resin if it is decided that the membrane is to be removed. These membranes can be reused many times even for different diameter domes. By selecting a urethane type coating, the membrane can adhere to the resin, thereby offering an additional corrosion barrier to corrosive liquids.

To insure the correct inflation pressure of the membrane, it may be desirable to use electronic pressure sensors and servo systems in conjunction with blowers in order to maintain the actual air pressure within, preferably, two percent of the desired air pressure. To further control the shape of the dome, a steel ring (such as in FIG. 26) of 3 to 5 feet in diameter may be used and bolted to the membrane in the center of the dome. This ring can be supported by a tower 84 (FIG. 3) to maintain the correct elevation and center of the dome. As shown in FIG. 1, the best mode contemplated provides a dome either comprised of a true ellipse or an ellipse derived from two circles. Once again, it is important to be aware that the correct shape of the inner membrane is important, as relatively large deviations from the true spirit and alignment of wall and dome can affect the ability of wall and dome to resist buckling.

Figure 21:
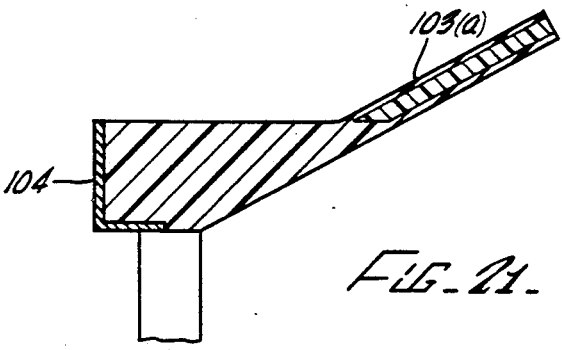
FIG. 21 illustrates another embodiment showing a connection between an FRC dome and an existing or new concrete wall.
Figure 16:
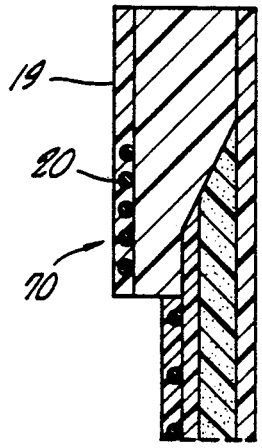
FIG. 16 shows added wall stiffening prestressing which can be used at the connection between the wall and the dome or at the top of open tank walls.
Figure 17:
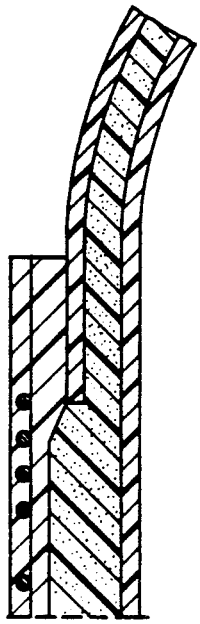
FIGS. 17 and 18 show details of several embodiments of wall and dome connections where the joined dome and/or walls are of different thicknesses.
Figure 18:
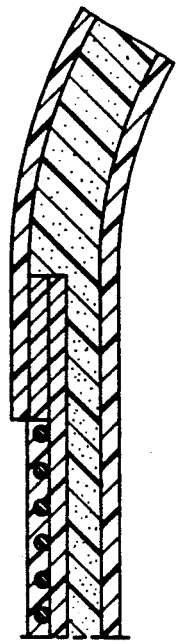
Figure 20:
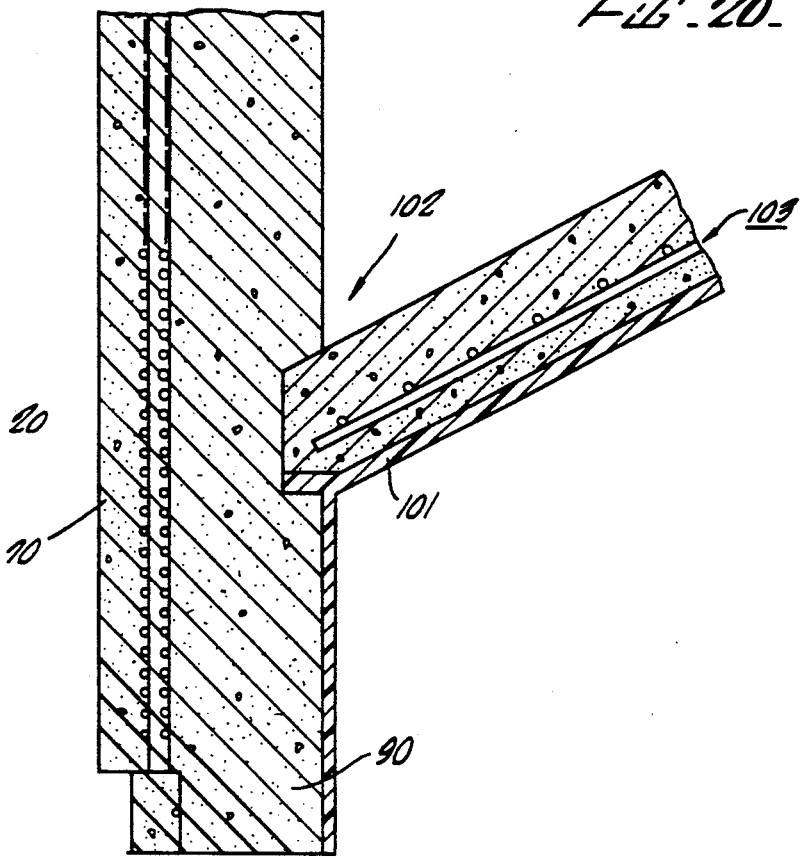
FIG. 20 illustrates another embodiment showing a typical connection between a prestressed concrete wall and a dome with an FRC lining.
Figure 19:
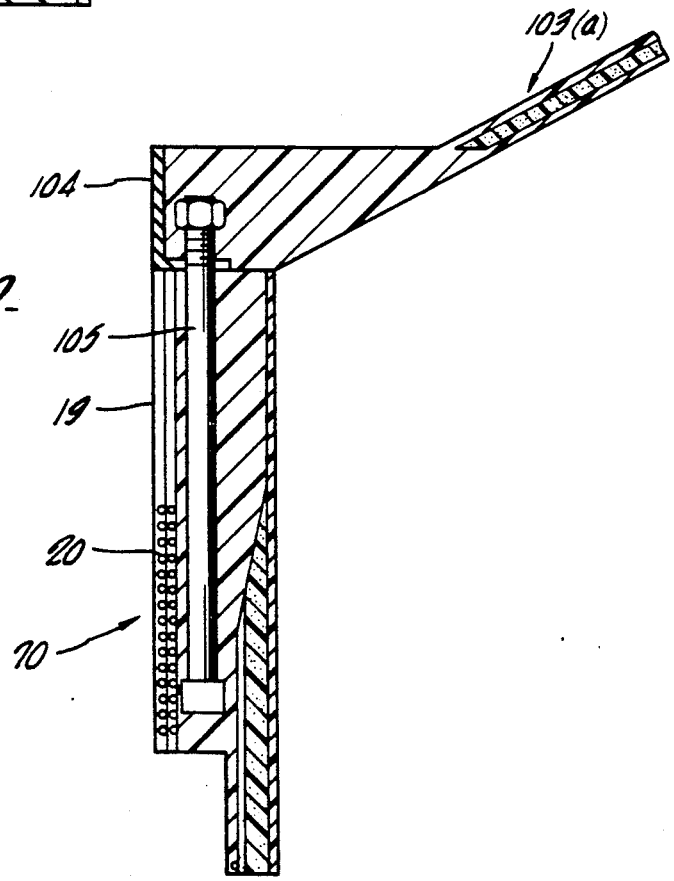
FIG. 19 is another embodiment of a wall/dome connection.

Once the walls are completed, if desired, one can proceed in the construction of the dome on roof. Different types of configurations as shown in FIGS. 16, 17 and 18 can be utilized to connect the walls to the roof or dome. The wall and dome connections can vary, and different methods of joining these multi-variant sections are indicated in FIGS. 16–21. Additionally, the subject invention also provides for the addition of domes, built onto already existing walls constructed from a variety of materials. For example, as shown in FIGS. 20 and 21 a fiber-reinforced plastic composite dome pursuant to this invention can be added to prestressed or reinforced concrete walls 90. In FIG. 20, steel or fiber reinforced resin angle 101, and notch or anchoring means 102, can be used to further support the roof 103, which can also be stressed or reinforced radially and circumferentially. In FIG. 21, an angle 104 is placed on the existing wall to hold the fiber reinforced resin. Additional prestressing 70 can be added in the upper portions of the walls such as shown in FIGS. 16, 19 and 20 which can be useful for stiffening the wall/dome connection or the top of an open tank such as that in FIG. 16. Additional prestressing 70 can be used to help contain certain bursting forces or prevent buckling. FIG. 19, another wall/roof connection, shows the use of a stainless steel angle 104 as a form for the fiber reinforced resin. A bolt 105 can be used to fasten the spherical dome 103(*a*) to the walls.

It may also be advantageous to provide openings either in the dome or in the walls of the tanks such as shown in FIGS. 22, 23 and 24. Turning to FIG. 22, a stainless steel ring 87 is used to reinforce a center opening in the roof 103(*a*). In many instances this type of opening is required to accommodate ventilators. In addition to center openings in the roof, other openings may be required for access holes, hatches, and pipes. For the typical center opening in FIG. 22, provisions can be made for a uniform tapered thickening of the dome shell to a steel ring 87 to resist various loads. If it is desired that the wall of a tank be strengthened particularly at a wall opening region such as is shown in FIGS. 23 and 24, the thickness of the middle sand-resin layer 88 can be increased and extra prestressing 88(*b*) can also be added. Such prestressing 88(*b*) will be placed in a manner that it offers a band free of wire at the elevation of the openings. The number of wires above and below the openings will be adjusted to allow for bursting force in the wire-free band around the tank wall. Steel ring 88(*a*) can also be used to aid in providing a suitable opening. In the alternative, particularly when the entire wall needs to be strengthened, shotcrete 90 (See, e.g. FIG. 20) can be sprayed to the full height of the wall with either a uniform thickness or a uniformly tapered thickness. The lower portion of the wall can also be made to curve inwardly to serve as an anchor to the prestressing and to prevent uplift. The shotcrete 90 can be reinforced with regular resin forcing steel or mesh or it may be prestressed vertically to a variable final stress of, for example, 200 psi. As with the wall/floor connection in FIG. 15, the shotcrete can be separated from the wall footing by teflon or other similar materials with low friction coefficients to facilitate easy movement of the wall relative to the inner concrete ring 24 (FIG. 4). Circumferentially the wall can be prestressed with hot dipped galvanized or stainless steel 304 wire of 0.196 diameter which can be wrapped around the shotcrete under an initial tension of 165,000 psi with an assumed final tension of 130,000 psi after allowance for all stress losses under prolonged tank (empty) condition.

Figure 25:
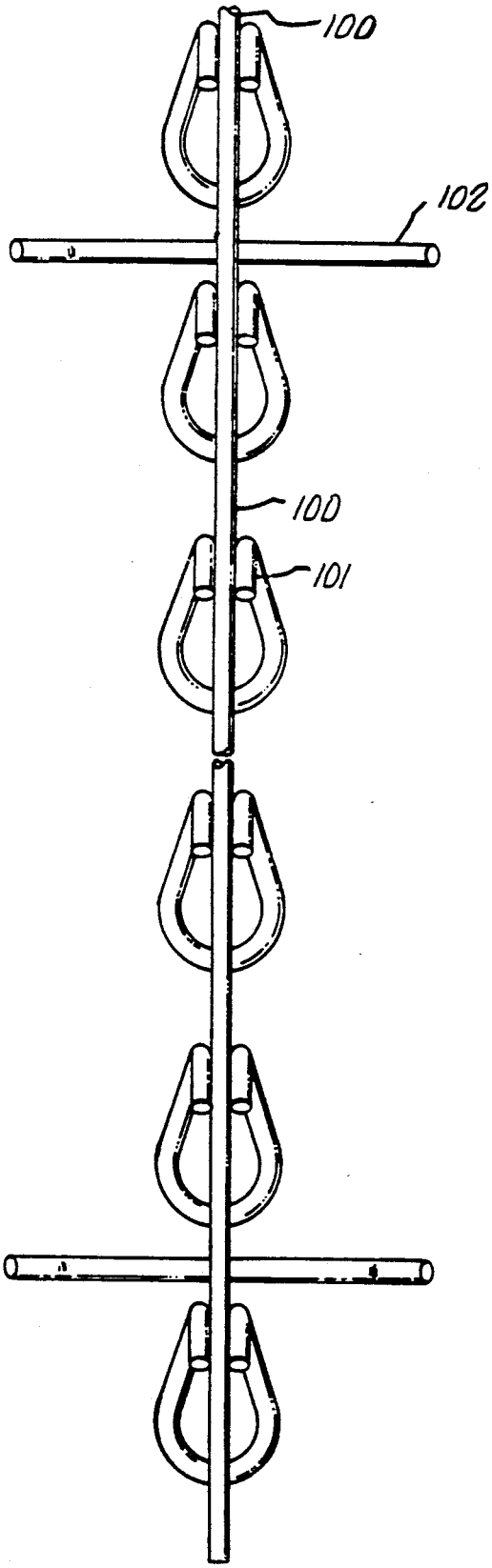
FIGS. 25 and 25A are front and side view of the radial prestressing wire used in yet another embodiment, showing cable spacers or hooks, as well as stabilizing bars.
Figure 25A:
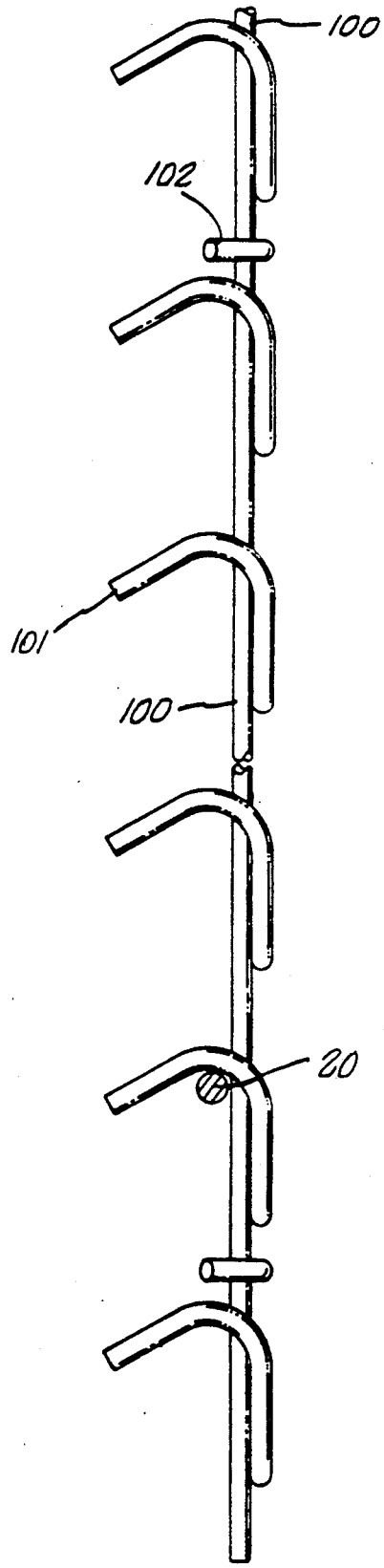
Figure 26:
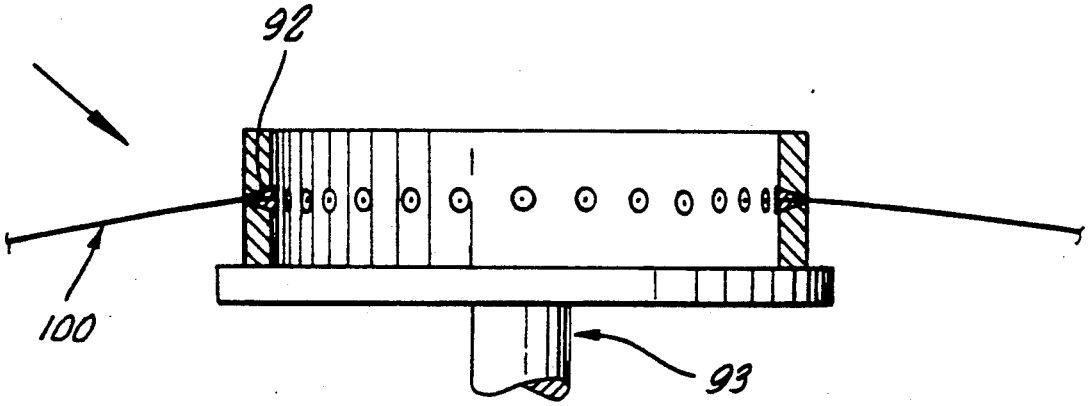
FIG. 26 is a cross-sectional view of the ring support which, in certain embodiments, holds the radial prestressing wire in place above the base of the structure.
Figure 27:
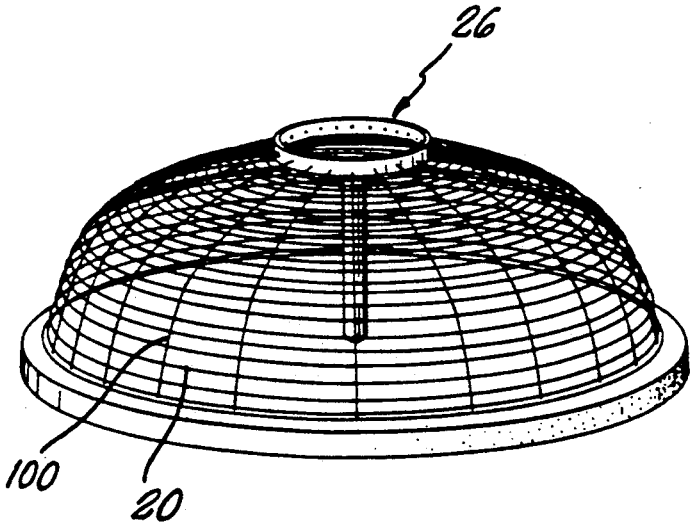
FIG. 27 is a perspective view of an embodiment of the claimed dome structure illustrating the interrelationship between the support ring, vertical and circumferential prestressing, membrane and footing of the structure.
Figure 28:
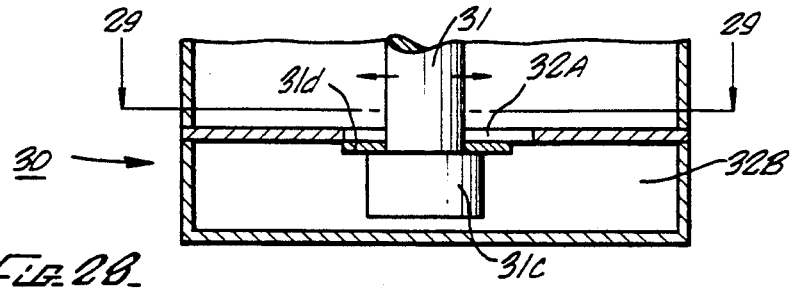
FIG. 28 is a side cut-out view of the seismic cans showing seismic bolt 31.
Figure 29:
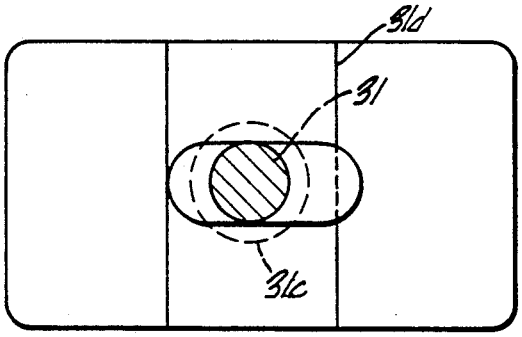
FIG. 29 is a top view, partly in phantom, showing a top view of the seismic can shown in FIG. 28.
Figure 31:
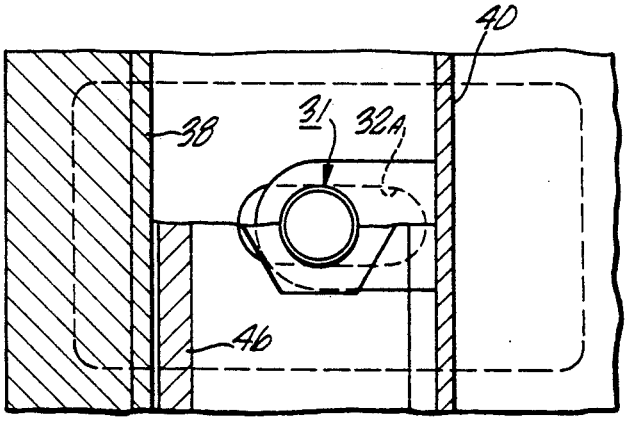
FIG. 31 is a top view cut through the wall 18 looking down at retainer ring 40 and floor ring 38.
Figure 30:
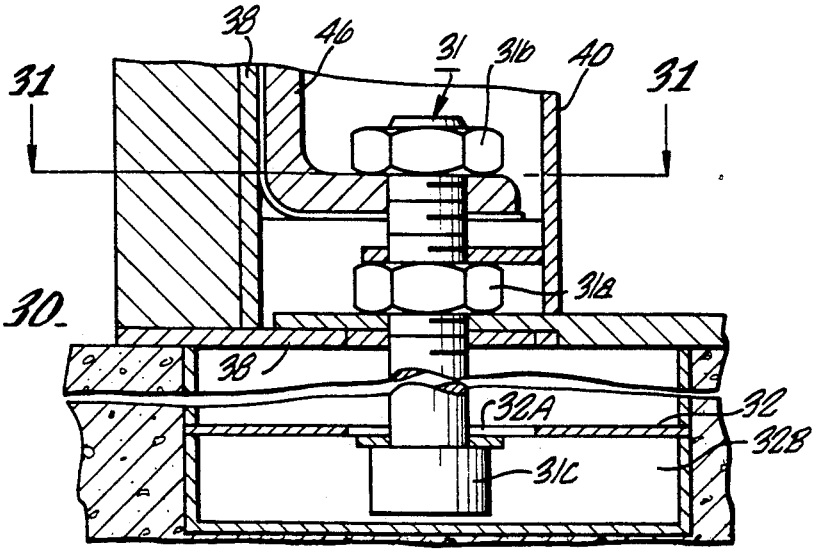
FIG. 30 is a top view cut through the wall of the seismic can showing the seismic bolt 31, with its head 31C sliding on the shoulder.

We now discuss the embodiment of the present invention illustrated in FIGS. 25, 25A, 26 and 27 of the drawings wherein radial prestressing is used on the outside of the membrane. As with application Ser. No. 559,911 now U.S. Pat. No. 4,776,145 issued Oct. 11, 1988, the radial prestressing is deployed on the outside of the membrane by the inflation of the membrane. Radial prestressing wires can be connected to a fastener such as the ring structure 91 in FIG. 26 which is preferably centered above the base of the structure. The ring 91 in FIG. 26 contains holes which receive and fasten the radial prestressing wires 100 (FIGS. 26 and 27). The prestressing can be fastened using wedge anchors 92. The ring support 91 can be positioned above the slab by a tower 84 (FIG. 3) or by other suitable means, such as the air pressure in the membrane. The radial prestressing members can be connected to ring 91 preferably located at the center of the dome structure, where it is suitably anchored. The wire prestressing extends from the ring 91 to the footing of the structure. Each wire is capable of being adjusted or tensioned to help maintain the desired shape or configuration, minimize skin stresses in the fabric, and ultimately provide radial prestressing to help contain the bursting force of the material stored within the dome structure.

The radial prestressing 100 (FIGS. 26 and 27) can include galvanized cable spacers or hooks 101 and stabilizing bars 102 as shown in FIGS. 25 and 25A. The cable spacers are attached to the radial prestressing, such as wire 100 which is anchored to the footing of the structure at one end and to the support ring 91 on the other. The cable spacers facilitate circumferential prestressing in that they can prevent the wrapped circumferential members, such as wires 20, from sliding up on the dome surface. The cable spacers and stabilizing bars also help minimize circumferential arching of the membrane between the radial wires. The stabilizing bars 102 allow for proper positioning of the cable spacers or hooks vis-a-vis the membrane. Instead of cable spacers or hooks, the exterior surface can also be stepped or keyed in the radial direction along the surface to accommodate the circumferential reinforcement.

Having described the details of the preferred embodiment, we now set forth an overview of the actual construction of an axis-symmetrical storage tank.

The first step in construction is preparing a site by grading, and compacting the sub-grade to 95% minimum density. A concrete pad is laid over the subgrade after the inner and outer concrete base rings have been constructed. The inner concrete base ring supports the inner membrane and walls of the tank, while the outer concrete base ring is used to support and anchor the outer membrane. The inner concrete base ring contains the seismic cans and seismic bolts which slide radially in and out in relation to the center of the tank and anchor the walls of the tank. The outer membrane, fastened to the outer concrete base ring, can be used to provide shelter during construction and protect the tank from the sometimes extreme variations in environmental conditions under which construction sometimes takes place. After the inner concrete base ring is constructed, a stainless steel floor ring or flange 38 is assembled completely around the tank partially over the inner concrete base ring. This will be used, in part, to butress and align the walls as well as to form a trough to contain the fiber reinforced composite or sand-resin mixture. The floor is then ready to be formed by placing a layer of fiber reinforced composite (FRC) on top of the steel floor flange, on part of the inner concrete base ring, and on the concrete pad. This fiberglass floor is secured to the stainless steel flange partially by means of the seismic bolts which are spaced equidistantly about the inner concrete ring and which protrude from the concrete ring and through openings in the stainless steel flange. The seismic bolts are slidably affixed to a housing in the seismic cans. These cans consist of a housing holding the seismic bolts. The heads 31C of the bolts 31 are housed in blocks within the seismic cans which are aligned in a radial direction from the center of the inner concrete ring. The nuts on these seismic bolts are screwed down finger tight on the fiber reinforced composite (FRC) floor allowing for relative sliding between the floor and the flange. A circular stainless steel retainer ring with attached lugs for fastening to the protruding seismic bolts is then installed and spot welded to the nuts on the seismic bolts. The open annular space or trough or volume created by the spaced relation of the circular stainless steel retainer ring and the stainless steel floor flange is then filled with sand-resin or composite thereby covering the volume over the nuts and creating a seal. Next, the inner membrane is installed by threading the holes in the membrane over the seismic bolts. The inner membrane of course, has been carefully cut and lapped to a pre-calculated pattern to achieve the desired geometry. Aluminum angles are then placed over the membrane and over the seismic bolts. These seismic bolts are used to secure the membrane, the FRC floor, and the stainless steel flange to the concrete ring footing. A second nut is used to affix the angles and membrane to the seismic bolts and, of course, to the inner concrete ring. The inner membrane is then inflated to achieve the desired geometry of the domes structure. If desired, vertical prestressing can be added outwardly of the membrane and deployed by the inflation of the membrane. These serve to help stabilize the structure and circumferential prestressing. Form work of aluminum channels are then erected within the inflated membrane and held in place by retainer brackets welded to the aluminum angles. To support the channel formwork, a truss network is employed at each level of channels. Each truss network is made up of a combination of fixed and adjustable members which are adjusted to provide the correct curvature on the interior of the walls. The truss network provides radial support for the formwork to ensure a circular alignment. If desired, curved aluminum channels are attached to every third straight aluminum channel to aid in further shaping of the dome of the tank. The walls of the tank consist of rigidifying material constructed on this membrane-formwork by first spraying a layer of fiber reinforced plastic (FRP), (utilizing glass or sheet fibers as reinforcing) which can also consist of polyester, vinyl ester or epoxy resins. In the best mode, this layer is followed by a layer of sprayed sand-resin followed by another layer of fiber reinforced plastic (FRP) material, also typically containing resin and steel or glass fiber reinforcement. Next, the lower portion of the tank is wrapped with circumferential prestressing material, by machine or other manual methods. The automated precision wrapping methods which are recommended are set forth in the patents granted to me which are incorporated herein by reference. If vertical prestressing is used, the circumferential prestressing interlinks and meshes with the vertical prestressing.

The prestressing material is applied under tension, and, accordingly, such tension is partially resisted by the presence of the wall-form support inside and adjacent to the membrane. In this respect, it is desirable that the formwork offers only a limited amount of resistance to the prestressing so it is desirable that the Young's modulus of the wall form support be substantially less than the Young's modulus of the prestressing material. The formwork should be able to "give" or be compressed by the prestressing. In other words the compressibility of the formwork and wall should be greater than that of the prestressing material.

Thus, when the steel wire is wrapped about the structure, a circumferential compression will develop in the fiber reinforced composite (FRC) and the aluminum channel wall form supports which causes in an inward movement of the wall-forms in turn resulting in a substantial reduction of stress in the steel wire. This reduces the compression in that portion of the FRC and the wall-form support to which it has been applied. This is what is meant by the compressibility of the wall forms being greater than the compressibility of the wall and prestressing.

After construction of the structure is completed, the wall-form supports (including angles 46) are removed. Their removal may also result in a further inward motion and increased compression of the rigidifying material and a correlative reduction of tension in the prestressing material (steel wire). Once again, it is preferable that the modulus of elasticity of the rigidifying material is substantially less than the modulus of elasticity of the prestressing material.

Thus, an improved construction of cylindrical or domed structures is disclosed. While the embodiments and applications of this invention have been shown and described, and while the best mode contemplated at the present time by the inventor has been described, it should be apparent to those skilled in the art that many more modification are possible without departing from the inventive concepts therein. The invention therefore can be expanded, and is not to be restricted except as defined in the appended claims and reasonable equivalence departing therefrom.

I claim:

1. A floor-to-wall junction of a containment vessel which rests on a foundation and has a floor and walls, comprising:

(a) a floor ring having flanges aligned substantially perpendicular to one another, one flange being substantially in the horizontal plane and one flange being substantially in the vertical plane, the walls of the tank resting on the horizontal flange and abutting the vertical flange;

(b) a retainer ring having fastening means to allow it to be connected in a spaced relation to the floor ring, said retainer ring and floor ring defining a trough in which rigidifying material is placed to form a seal between the walls and the floor in the interior of the containment vessel.

2. The structure of claim 1 wherein the rigidifying material is fiber reinforced plastic.

3. A prestressed dome structure with substantially cylindrical walls of sandwich composite construction comprising:

(a) a foundation having anchoring means attached thereto which permit horizontal seismic forces acting on the wall to be substantially restrained tangentially to said walls;

(b) a floor ring resting on said foundation and held in place by said anchoring means;

(c) a floor placed partially on said floor ring and also held in place by said anchoring means;

(d) said floor ring having a flange abutting the walls;

(e) a retainer ring, also held in place by said anchoring means, forming an annular volume in relation to said floor ring;

(f) rigidifying material placed in said annular volume forming a seal between said floor and said walls.

4. A prestressed containment vessel having walls resting on a foundation comprised of the following elements:

(a) a concrete foundation having seismic anchor means attached thereto;

(b) substantially circular walls being supported by said concrete foundation and anchored to the foundation by said seismic anchor means in a manner wherein horizontal seismic forces are substantially resisted tangentially to said circular walls;

(c) a floor resting in part on said foundation and connected to said walls;

(d) a floor ring having a substantially vertical portion for interfacing with the walls;

(e) said walls being of sandwich composite construction and resting on said floor ring abutting the vertical portion thereof;

(f) retainer ring means positioned inwardly in relation to said floor ring to form an annular volume for containing rigidifying material;

(g) rigidifying material placed in said annular volume affixing the seismic anchor means, the floor, and the walls of the tank in a liquid impervious sealing arrangement.

5. The prestressed containment vessel of claim 4 wherein a roof is anchored to the tope of said walls.

6. A floor-to-wall junction of a substantially cylindrical containment vessel which rests on a foundation and has a floor and walls, comprising:

(a) a floor ring having flanges aligned substantially perpendicular to one another, one flange being substantially in the horizontal plane and one flange being substantially in the vertical plane, the walls of the containment vessel resting on the horizontal flange and abutting the vertical flange;

(b) a retainer ring having fastening means to allow it to be connected in a spaced relation between the foundation and the floor-to-wall junction, said retainer ring defining a trough in which said fastening means may slide substantially in a radial direction so designed to resist horizontal seismic forces substantially tangentially to said walls and;

(c) rigidifying material placed in said floor ring to form a seal around said fastening means in the floor-to-wall junction.

* * * * *